US007837598B1

(12) United States Patent
Boozel, Jr.

(10) Patent No.: US 7,837,598 B1
(45) Date of Patent: Nov. 23, 2010

(54) EXERCISE BAR WITH ADJUSTABLE ANGLE HANDLES

(76) Inventor: Leroy J. Boozel, Jr., 25 Pine Street, Mount Union, PA (US) 17066-2019

( * ) Notice: Subject to any disclaimer, the term of this patent is extended or adjusted under 35 U.S.C. 154(b) by 0 days.

(21) Appl. No.: 12/561,332

(22) Filed: Sep. 17, 2009

(51) Int. Cl.
*A63B 1/00* (2006.01)

(52) U.S. Cl. ..... 482/38

(58) Field of Classification Search ..... 482/139, 482/126, 91–92, 148, 55, 37–38, 93–103, 482/35, 51
See application file for complete search history.

(56) References Cited

U.S. PATENT DOCUMENTS

| | | | | |
|---|---|---|---|---|
| 629,630 | A | 7/1899 | Boland | |
| 4,949,956 | A | 8/1990 | Pobran | |
| 5,277,684 | A | 1/1994 | Harris | |
| 6,090,020 | A * | 7/2000 | Webber | 482/100 |
| 7,204,790 | B2 | 4/2007 | Sleamaker | |
| 7,387,595 | B2 | 6/2008 | Towley | |
| 7,476,184 | B1 | 1/2009 | Batca | |
| 7,482,050 | B2 | 1/2009 | Olson | |
| 7,604,576 | B2 * | 10/2009 | Drechsler | 482/99 |

OTHER PUBLICATIONS

Boland U.S. Appl. No. 60/130,953, filed Apr. 26, 1999, Miscellaneous Incoming Letter.

* cited by examiner

*Primary Examiner*—Lori Baker
(74) *Attorney, Agent, or Firm*—Graham S. Jones, II

(57) ABSTRACT

An exercise bar includes a pair of handles having proximal ends with at least one fulcrum hole extending through the proximal end of each thereof. A center plate has a periphery and a pair of pivot holes therethrough. One of a pair of pivot pins is inserted through each of the fulcrum hole and a pivot hole to connect the handles to the center plate. Locating means extending through the center plate are spaced about the periphery thereof. Movable locking elements in the form of locking pins or clevis type pins are inserted into selected ones of the locating means to retain the handles at selected angular positions relative to the center plate.

20 Claims, 10 Drawing Sheets

11C
11S
17
12
12R
RS'
17S
11H
11S
17S
12
LS'
12L
11S 20
23
20S
20T
20L 13R
13E
13G
13S
13F
18
14
13Y
22

12
12H
12G
12F
RS'
12E
15
11
11C
11S
12P
12S
15
11H
11B
12D
14
13F
13S
18
17S
12P
12C
LS'
12B
12A
13Y
17
17S
13G
13E
13L 11
11C
11H
11B
11S
17
17S
12S
RS'
LS'
FB'
12
12A
12B
12C
12D
12E
12F
12G
12H
12P
13L/13R
13B
13S
13F
13P
13C
13Y
13R
13L
13G
13E
14
15
18
BH

EXERCISE BAR WITH ADJUSTABLE ANGLE HANDLES

BACKGROUND OF THE INVENTION

This invention relates to exercise apparatus, and more particularly to a handle bar adapted for connection to a cable linked to weights for performing exercises such as strengthening, trimming, and/or toning muscles.

Physical fitness and exercise are increasingly important to a large segment of the population. With advances in medical science, which have increased the average human life expectancy, there is a natural interest in improving the quality and enjoyment of life during this increased lifespan. Thus, an increasing number of people employ exercise to improve their appearance, health and sense of well-being.

In the exercise field, it is well known that to maintain the growth of muscles, it is desirable to change the training regimen occasionally, e.g. by changing the angle, number of repetitions and different exercises. In the past, to change the angle of handles being used during exercise, it has been necessary to replace the handle attached to the exercise machine thus interrupting the process of exercising. The time required to make the change prolongs the duration of the period that the athlete is deprived of the benefit of tension on the muscle which should be as short as possible according to experts in the exercise field.

The tricep brachii (three-headed) muscle, located in the back of the upper arm, has three heads, which are the long, the lateral and the medial heads. The long head in the tricep muscle which extends down the inside of the arm along the humerus (the upper arm bone) is the largest and longest one of the heads. The medial tricep muscle head, which is smaller, is located in the center of the tricep muscle. The lateral head is located on the outward facing side of the humerus. The lateral head displays a horseshoe shape when tricep muscles are well developed.

To build the tricep muscle, an athlete can hook an exercise bar to a link at the top of a standard lat machine whereby a weight stack supplies resistance from an interconnecting cable system. This allows the athlete to perform a push-down exercise where the exercise bar is pushed down from above the head or eyes of the athlete toward the floor. In the past, exercise stations have included exercise bars with hand grips linked by pulleys to lift one or more weights in a weight stack to use a pull-up motion to lift the weights or to use a push-down motion to lift the weights. In other words, in either case the weights in the weight stack are lifted by applying a force to the exercise bar. Different exercise bar designs have been employed such as the press-down bar and the pull-up bar which are employed to exercise different muscle groups of the body. A typical tricep press-down exercise bar includes a flat plate at the top with a hole for connection to a spring snap hook and two handles reaching down from the flat plate at an angle of 45 degrees with rubber hand grips.

Tricep push-downs are an isolation exercise for the triceps which is the muscle along the back of the arm. The exercise is done using a high pulley or pull-down machine. This is one of the most common and easy to learn tricep exercises. To perform a tricep push-down exercise, first one stands facing a high pulley with a short push-down bar. Then one grips the bar with a palms-down, less than shoulder width grip. Start with the bar at about chin level. Let the bar up. Let the upper arms angle up again until the bar is at chin level. Repeat. Keep your lower back slightly arched tight and the chest out. At the bottom of the movement, one should try to push the bar straight down towards the floor as though trying to push the body upwardly. This will increase the contraction.

There are exercises to strengthen the latisimus dorsi (hereinafter lats) which are the broad flat muscles on either side of the back using a lat machine. A lat pull-down exercise bar is totally horizontal or horizontal from the center and angled downwardly on the distal portions of the bar to permit holding the bar at two different orientations. The pull-down exercise is performed using a cable pull-down weight machine, while seated by pulling down with the hands on a wide bar towards the upper chest or behind the neck. This exercise involves the biceps, forearms, and the rear deltoids.

SUMMARY OF THE INVENTION

An exercise bar in accordance with this invention may be used to train various muscles including the back muscles. One can attach an exercise bar in accordance with this invention bar to the upper section of a lat machine and perform an exercise known as a pull-down by pulling the bar to upper chest level with palms facing forward and/or backward. Again, the angle setting of the bar will train the back muscles in a different manner through the release of the locking pins. Similarly, by attaching the bar to a lower pulley on the lat machine an exercise called a bent-over row may be completed. This is accomplished by pulling the bar upward to the lower abdomen. Additionally, by sitting on a seat or the floor of the exercise room, an athlete may also perform an exercise known as a seated pulley cable row.

With an exercise bar in accordance with a preferred embodiment of this invention, the athlete can adjust the angle of the bar through four settings, one straight angle, one 25 degree angle, one 48 degree angle and the third 65.34 degree angle by pulling back a locking pin and setting the angle, all done without changing the bar on the cable system.

An exercise bar in accordance with this invention also allows an athlete to train the bicep muscles by attaching the bar to the lower pulley system of the lat machine and doing standing bicep curls which start from arms extended at waist level and curling the bar to the chest. As with all the previously mentioned exercise types, changing the angle of the bar will work the biceps in different ways.

Finally, an athlete can perform shoulder exercises by attaching an exercise bar in accordance with this invention to the lower pulley on a lat machine, starting with the exercise bar in an overhand grip, palms facing down, and pulling the exercise bar to the chin which is known as an upright row.

During the process of exercising with a weight machine the person using the machine will need to change exercise bars as different exercises are performed. In the past exercise bars have been rigid and could not be adjusted. The time and effort required to remove one exercise bar from a weight machine cable and to replace it with another exercise bar is a problem because the other exercise bar must be located near the exercise machine and it is necessary to have at least two different exercise bars. An additional problem is that the angles of the handles on the exercise bars are limited unless one has several alternative exercise bars which require more exercise bars and more storage for the additional exercise bars.

Accordingly I have found that it is desirable to have a single exercise bar which is adapted for adjustment of the angle of the handles relative to the angle of the weight machine cable to which it is attached. Moreover, I have also found that it is desirable to be able to adjust the angle of the handles on the exercise bar without removing the exercise bar from the weight machine cable. One of the main benefits of a bar in accordance with the present invention is that since most exercise experts recommend training with a partner for safety reasons and inspiration, if the person exercising is dissatisfied with the angle of the exercise bar it can quickly be changed to the preferred angle by the partner, thus eliminating delay as well as eliminating the need to change the exercise bar.

There are also two other triceps exercises which can be done with the bar of the present invention. One is called a lying cable triceps extension. Place a flat bench in front of a low-pulley cable station with the bar attached. Lying face up with the head close to the stack, reach back over the head and grasp the handles of the exercise bar. With straight arms, bring the exercise bar over the face. Bend the elbows to lower the bar slowly toward the forehead. Stop an inch or so away and after a pause, lock the upper arms in position, and contract the triceps to drive the exercise bar upwardly in a smooth arc.

In accordance with this invention, when preparing for a "Cable Bent-over Extension," grasp the cable bar from a medium high pulley with narrow or shoulder width overhand grip. Turn the body away from the pulley apparatus and position the turned cable bar behind the neck. Bend over downward with the cable bar positioned behind the neck gripped at each side. Lunge forward with one leg. Allow the elbows to be pulled back under cables resistance. In execution, extend the forearms forward until the elbows are straight. Allow the cable bar to return back over neck. Repeat.

Further, in accordance with this invention, in preparation for a "Cable Incline Pushdown" lie on an incline bench facing away from a high pulley machine. Grasp a cable attachment overhead with an overhand narrow grip. Position elbow to sides, slightly up. In execution of the Cable Incline Pushdown, extend the arms with the elbows stationary. Return until the forearm is close to the upper arm. Repeat.

In accordance with this invention, in preparation for a "Cable Incline Triceps Extension," grasp the cable bar from behind with a narrow overhand grip. Position the elbows overhead. When executing the Cable Incline Triceps Extension, extend the forearm overhead. Then, lower and repeat the exercise.

Further, in accordance with this invention, in preparation for a "Cable Preacher Curl," Sit on a preacher bench placing the backs of the arms on a pad. Grasp a cable bar with a shoulder width underhand grip. In execution of the Cable Preacher Curl," raise the cable bar toward the shoulders. Lower the cable bar until the arms are fully extended. Repeat. The seat should be adjusted to allow the arm pit to rest near the top of the pad. The back of the upper arm should remain on the pad throughout the movement. The long head (lateral head) of biceps brachii is activated significantly more than the short head (medial head) of biceps brachii since the short head enters into active insufficiency as it continues to contract. At bottom position, weight stack in use should not make contact with remaining weight stack.

In accordance with this invention, in preparation for a "Cable Reverse Preacher Curl," sit on a preacher bench placing the back of the arms on a pad. Grasp the cable bar with a shoulder width overhand grip. When executing the Cable Reverse Preacher Curl, raise the cable bar toward shoulders. Lower cable bar until arm is fully extended. Repeat. The seat should be adjusted to allow the armpit to rest near the top of a pad. The back of the upper arm should remain on the pad. At the bottom position, the weight stack being used should not make contact with the remaining weight stack.

As stated previously, in accordance with this invention, changing the angle of the exercise bar will work the triceps/biceps muscle in a different way and effectively encourage muscle growth. The "Lat Pull-Down" exercise is performed at a workstation with adjustable resistance. While sitting with the upper thighs restrained under a thigh pad, pull a hanging bar down toward chin level and then release for one repetition. The exercise works the back muscles, especially the latissimus dorsi or the "lats," the muscle just under the armpits and spreading across and down the back. Alternative grips can be used—wide, narrow, under- or over-hand—in order to target specific muscle groups.

The "Cable Row" exercise is performed at a workstation with adjustable resistance. The muscles worked are the back muscles in general, particularly the latissimus dorsi; forearm muscles, upper arm muscles. The body is positioned by sitting on the platform with knees bent. Grasp the cable attachment which is often a triangle handle but may be an exercise bar. With the knees slightly bent position reach to grab the handle with outstretched arms yet without curling the lower back over. Apply the "straight back" employed in squat and deadlift exercises. With the abdominals braced one is ready to row. As with previous exercises, changing the angle of the exercise bar will work the back muscles in different ways.

In accordance with this invention, an exercise bar comprises a pair of handles with proximal ends and at least one fulcrum hole extending through each of the proximal ends. A center plate has a periphery and a pair of pivot holes therethrough. One of a pair of pivot pin is inserted through each fulcrum hole and a pivot hole. Locating means are formed extending through the center plate spaced about the periphery thereof. Movable locking elements such as locking pins are inserted into selected ones of the locating means for retaining the handles at selected angular positions relative to the center plate. Preferably, the center plate includes retaining locating means such as detents or notches in the periphery; and each handle includes a spring biased locking pin housed therein for insertion into a selected one of the detents or notches. A coupling is connected to the center plate by a swing bearing therein which houses a shaft secured to the center plate. Each handle has a proximal end which includes a pair of prongs and a slot therebetween for insertion onto the center plate. Each handle has a longitudinal slot for housing a locking pin with shoulders extending outside the handle for manual withdrawal of the locking pin into the handle from a locking position.

Preferably, the center plate includes locating means in the form of locating holes therethrough or notches in the center plate proximate to the periphery thereof; and each handle includes a pin extending therethrough and through one of the locating holes. A coupling is formed on an upper portion of the center plate with a coupling hole therethrough. Each handle has a proximal end which includes a pair of prongs and a slot therebetween for insertion onto the center plate. The coupling is connected to the center plate by a swing bearing formed therein and a swing shaft secured to a housing slot in the center plate at the top thereof by alignment slots formed in opposite ends of the swing shaft and welds of the swing shaft to the center plate.

In accordance with another aspect of this invention, an exercise bar comprises a center plate having a periphery and a pair of pivot holes therethrough and of a pair of handles each of which has a proximal end including a pair of bilateral prongs separated by a transverse slot for insertion of the proximal end of the handle onto the center plate. Fulcrum holes extend through the bilateral prongs in the proximal end of each of the handles. One of a pair of pivot pins is inserted through each of the pivot holes and the fulcrum holes rotatably joining the handles to the center plate. Locating means formed extending through the center plate spaced about the periphery thereof including detents or notches in the periphery thereof. A pair compression springs and an associated movable locking pin in each pair. Each handle includes a coaxial bore in the proximal end thereof for housing a compression spring and each handle includes one of the movable locking pins. One of the compression springs and one of movable locking pins inserted into each of the coaxial bores. A coupling has a means for attachment formed therein. The coupling is connected to the center plate by a swing bearing formed therein housing a swing shaft secured to the center plate.

Preferably, a housing slot is formed extending through the center plate at the top thereof with the housing slot having edges defined by the center plate; a coupling is connected to the center plate by a swing bearing and a swing shaft; and the swing shaft is secured to the edges of the housing slot in the center plate. Preferably, alignment slots are formed in opposite ends of the swing shaft which overlap the edges of the housing slot; welds are formed between the ends of the swing shaft and the center plate along the edges of the housing slot thereby securing the swing shaft to the center plate; and the pivot pin comprises a hollow spring pin. Preferably each of the locking pins is inserted into a selected one of the locating means for retaining the handle associated therewith at selected angular position relative to the center under mechanical bias exerted by the compression spring associated therewith. Each spring biased locking pins retains the handle associated therewith in a locked position relative to the periphery of the center plate by insertion thereof in a selected one of the locating means including a detent or notch. The pivot pin comprises a hollow spring pin; and each of the locking pins is inserted into a selected one of the locating means for retaining the handle associated therewith at selected angular position relative to the center under mechanical biased exerted by the compression spring associated therewith.

In accordance with still another aspect of this invention, a method is provided for operating of an exercise bar including a pair of handles having proximal ends with at least one fulcrum hole extending through the proximal end of each thereof with a center plate having a periphery and a pair of pivot holes therethrough a pair of pivot pins inserted through each of the fulcrum hole and a pivot hole locating means formed extending through the center plate spaced about the periphery thereof; and movable locking elements including spring biased locking pins or removable pins. The method includes adjusting angles of the handles by the following steps. Release at least one of the locking elements for at least one of the handles which is in a first position; adjust angular position of the handle from the first position to a second position; alter positions of the movable locking elements into selected ones of the locating means for retaining the handles at selected angular positions relative to the center.

The invention and objects and features thereof will be more readily apparent from the following detailed description of the preferred embodiments of the invention with reference to the attached drawings.

The detailed description which follows explains the preferred embodiments of the invention, together with advantages and features with reference to the drawings.

DETAILED DESCRIPTION OF PREFERRED EMBODIMENTS OF THE INVENTION

As stated above, in the exercise field, it is widely recognized that to keep muscles growing it is desirable is to change the training regimen occasionally, e.g. by changing the angle, number of repetitions and different exercises. This is where the exercise bar in accordance with the present invention excels.

Figure 1A:
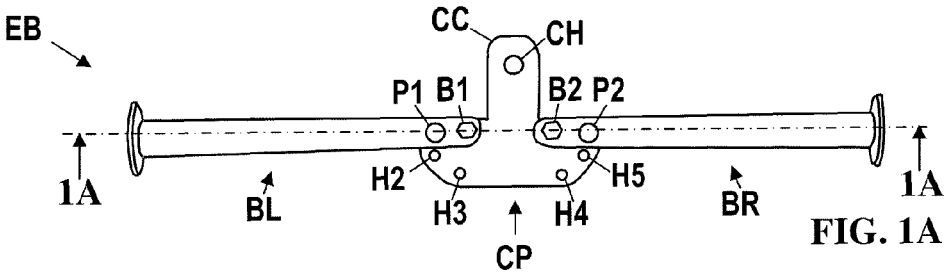
FIG. 1A is an elevational view of one embodiment of an adjustable exercise bar in accordance with this invention which includes a center plate and left and right handles.
Figure 1B:
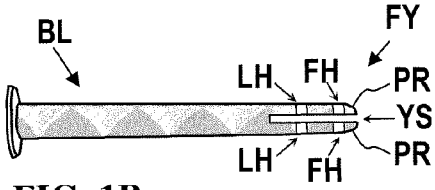
FIGS. 1B and 1C are sectional views taken along line 1A-1A in FIG. 1A of the left handle and the right handle respectively of the exercise bar of FIG. 1A.
Figure 1C:
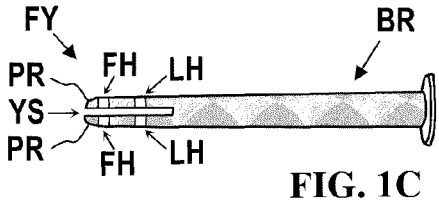
Figure 1E:
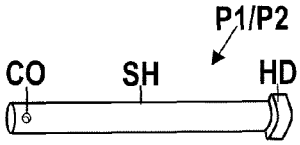
FIG. 1E is a drawing of a conventional clevis pin which two of which are used to retain the handles of the exercise bar in each of three different angular positions relative to the center plate.
Figure 1D:
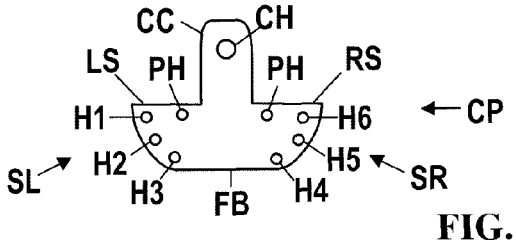
FIG. 1D is an elevational view of the center plate of FIG. 1A.
Figure 1F:
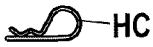
FIG. 1F is a drawing of a conventional hair pin cotter adapted to retain a clevis pin of the type shown in FIG. 1E.

FIGS. 1A-1F all show features of a first embodiment of the present invention. The center plate CP, which is shown in FIGS. 1A and 1D, includes a pair of pivot holes PH. Each of a pair of handles including a left handle BL and a right handle BR is rotatably secured to the center plate CP by a threaded bolt B1/B2 extending through fulcrum holes FH shown in FIGS. 1B and 1C and through and one of the two pivot holes PH in the center plate CP, so that each handle BL/BR can rotate independently with respect to the center plate CP about the respective one of the bolts B1/B2 which is secured in the respective one of the pivot holes PH. The center plate CP also includes bilateral sets of lock holes LH through the handles BL/BR shown in FIGS. 1B and 1C for retaining the left and right handles BL/BR in a selected one of three different angular positions as each of the left and right handles BL/BR rotates about a pivot hole PH in the center plate CP. Each of the repositioned handles BL/BR is independently locked into position by the respective one of the clevis type, locking pins P1/P2 shown in FIG. 1E inserted into the respective one of the lock holes LH in the center plate CP, when cotter pins HC shown in FIG. 1F are inserted through the respective one of the clevis type, locking pins P1/P2 to retain each of them in a selected position Referring to FIG. 1A an elevational view is shown of one embodiment of an adjustable exercise bar EB in accordance with this invention which includes a center plate CP which supports the pair of adjustable angle handles BL and BR including a left handle BL and right handle BR. The center plate CP has semicircular side edges 12L/12R on the left and right, a flat bottom edge FB and an upper cable connection CC.

FIGS. 1B and 1C show sectional views taken along line 1A-1A in FIG. 1A of the handles BL and BR respectively.

FIG. 1D shows that on the left and right sides the center plate CP a pair of pivot holes PH extend through of the center plate CP. Each of the handles BL/BR is rotatably secured to the center plate CP by a respective one of a pair of bolts B1/B2 extending through the corresponding one of the handles BL/BR and e the corresponding one of the pivot holes PH. Each of the bolts B1/B2 is retained in the center plate CP and the handles BL/BR by a respective one of two nuts (not shown) so that the respective one of handles BL/BR can rotate about the respective one of one of the pivot holes PH.

The center plate CP also includes bilateral sets of locating holes H1-H6 for locating the handles BL/BR, with locating holes H2-H5 shown in FIG. 1A and all the holes H1-H6 seen in FIG. 1D. Locating holes H1-H6 retain each one of the left and right handles BL/BR in a selected one of three different angular positions as each handle BL/BR is locked into position by one of two clevis pins P1/P2 after rotating about the corresponding one of the bolts B1/B2 in the corresponding pivot hole PH in center plate CP.

FIGS. 1B and 1C show sectional views taken along line 1A-1A in FIG. 1A of the handles BL and BR respectively. Each of the handles BL and BR has a forked clevis yoke FY formed in the proximal end thereof for joining it to the center plate CP with threaded bolts B1 and B2 passing through the fulcrum holes FH respectively as described above. As shown in FIGS. 1B and 1C each of the proximal ends of the handles BL and BR has been machined in the proximal end thereof to create the transverse clevis slots YS thereby forming the forked clevis yokes FY. Each forked clevis yoke FY has bilateral prongs PR aside from the clevis slot YS. The handles BL and BR are adapted for assembly with the center plate CP by sliding the center plate CP into each of the yoke slots YS in the handles BL and BR with the bilateral prongs PR of the forked clevis yokes FY straddling the opposite surfaces of the center plate CP.

An exemplary clevis pin P1/P2 is shown in FIG. 1E. As will be well understood by those skilled in the art, a clevis pin P1/P2 is a fastener including a shaft SH with a head HD at one end, and a transverse cotter pin hole CO extending therethrough at the other end. In other words, the cotter pin hole CO extends through the shank SH at the opposite end of the clevis pin P1/P2 from the head HD. After the clevis pin P1/P2 has been inserted through one of the locating holes H1-H6 and through the center plate CP and the lock hole LH in the handle BL/BR, it is necessary to lock the clevis pin P1/P2 in position. Thus, a cotter pin HC is inserted through the cotter pin hole CO of the clevis pin P1/P2 so the respective handle BL/BR is retained in the selected position.

In accordance with a preferred embodiment of this invention, a quick release hair pin cotter HC is inserted through the cotter pin hole CO to keep the clevis pin P1/P2 in place after adjustment of the handles BL and BR to the positions in which they are to be secured.

The repositioned handles BL/BR are locked into position by the clevis pins P1/P2 which are inserted into the locking holes PH in the center plate CP followed by insertion of cotter pins HC shown in FIG. 1F through the clevis pins to retain them in position. In summary, the center plate CP includes a pair of pivot holes PH. Each handle BL/BR is secured by a bolt B1/B2 and nut extending through the handle BL/BR and the pivot hole PH so that it can rotate about the pivot hole PH. The center plate CP also includes bilateral sets of locking holes H1-H3 on the left and locking holes H4-H6 on the right for retaining the left and right handles BL/BR in a selected one of three different angular positions as each handle rotates about a pivot hole PH in the center plate CP. The repositioned handles BL/BR are locked into position by a clevis pins P1/P2 inserted into the locking holes H1-H6 in the center plate CP, when cotter pins HC are inserted through the clevis pins P1/P2 to retain them in position.

The exercise bar EB with handles BL and BR shown in FIG. 1A need not be removed from the exercise cable attached to the exercise machine to have the angle of the handles changed. There are three settings to which one can adjust the handles BL and BR on the bar EB in FIG. 1A while continuing the process of exercising. The present invention eliminates the need to change exercise bars, i.e. remove and replace exercise bars, when changing from one angle of the handles on an exercise bar to another angle, thus saving the athlete time. Additionally, attachment of the exercise bar in accordance with the present invention to a lat machine gives the athlete the added benefit of substantially constant tension on the muscle being exercised, which is also recognized as a benefit by experts in the exercise field.

The exercise bar EB in accordance with this invention may also be used to train the back muscles. With an exercise bar in accordance with this invention attached to the upper section of a lat machine one can perform an exercise known as a pull-down by pulling the exercise bar to upper chest level with palms facing forward and/or backward. Again, the angle setting of the exercise bar will train the back muscles in a different manner through the release of the locking pins. Similarly, by attaching the exercise bar to a lower pulley on the lat machine an exercise called a bent-over row may be completed. This is accomplished by pulling the exercise bar upward to the lower abdomen.

Additionally, by sitting on a seat or the floor of the exercise room, the athlete may also do this same type of exercise which is called a seated pulley cable row. The exercise bar in accordance with this invention also allows the athlete to train the bicep muscles by attaching the exercise bar to the lower pulley system of the lat machine and doing cable bicep curls which start from arms extended at waist level and curling the exercise bar to the chest. As with all the previously mentioned exercise types, changing the angle of the exercise bar will work the biceps in different manners. Finally, the athlete may train the shoulders with this exercise bar by attaching the exercise bar to the lower pulley on a lat machine, starting with the exercise bar in an overhand grip, palms facing down, and pulling the exercise bar to the chin which is known as an upright row.

Then to secure the forked clevis yokes FY of the handles BL and BR to the center plate CP for rotation to selected positions relative to the side edges 12L and 12R, the threaded bolts B1 and B2 are inserted through fulcrum holes FH in the handles BL and BR and the pivot holes PH (shown in FIG. 1D) in the center plate CP. The threaded bolts provide pivotal support for the handles BL and BR at the proximal ends thereof. The bolts B1 and B2 are secured in position by conventional threaded lock nuts (not shown.) at the backs of the handles BL and BR. The handles BL and BR are adapted to be locked into one of three adjustable angular positions relative to the center plate CP by respective clevis pins P1 and P2 such as clevis pin P1/P2 shown in FIG. 1E. In FIG. 1A the clevis pins P1 and P2 are shown passing through lock holes LH in the handles BL and BR and extending through the locking holes H1 and H6 in the center plate CP. Each of the clevis pins P1 and P2 has a cotter pin hole CO for retaining it in position by insertion therethrough of a conventional quick release hair pin cotter HC, composed of spring steel, as illustrated in FIG. 1F. The handles BL and BR can be rotated from the horizontal position shown to a first lower angle by inserting the clevis pins P1 and P2 through locking holes H2 and H5 respectively in the center plate CP. In addition, the handles BL and BR can be rotated to the lowest angle by inserting the clevis pins P1 and P2 through locking holes H3 and H4 respectively in the center plate CP. The exercise bar EB is adapted to be employed to pull or push a weighted cable 23 such as the one shown in FIG. 12 in which an exercise bar 10 including a second embodiment of this invention is shown.

FIGS. 1B and 1C are sections taken along line 1A-1A in FIG. 1A of the left handle BL and the right handle BR respectively showing the fulcrum holes FH near the proximal ends of the handles BL and BR and lock holes LH spaced towards the distal ends of the handles. In FIGS. 1B and 1C the proximal ends of the handles BL and BR are shown to have cuts machined across the axis at the ends thereof to create transverse, forked clevis slots YS. The forked clevis slots YS form forked clevis yokes FY with bilateral prongs PR aside from the slots YS. The forked clevis yokes FY are adapted for assembly with the center plate CP by sliding the center plate CP into yoke slots YS in the handles BL and BR with the bilateral prongs PR of the forked clevis yokes FY straddling the opposite surfaces of the center plate CP thereby permitting the handles BL and BR to grip the center plate CP between the bilateral prongs PR.

FIG. 1D shows a front view of the center plate CP of the exercise bar EB which includes a coupling comprising a rigid cable connection CC projecting from the center of the top of the center plate CP, A cable hook hole CH is formed in the center of the cable connection CC proximate to the top thereof. The cable hook hole CH extends through the cable connection CC portion of the center plate CP for receiving a spring snap hook 22 of the kind shown in FIG. 14 for connection of the center plate CP to a weight bearing cable of the kind illustrated in FIG. 12 which is described in detail below. The main body of the center plate CP has the flat bottom edge FB located between arcuate bilateral side edges including a left side edge SL and a right side edge SR. The side edges SL/SR are circular segments centered on the corresponding pivot hole PH. Spaced along the curves of the arcuate bilateral side edges of the center plate CP are openings provided as handle locating means in the form of six lock holes H1-H6, each of which extends through the thickness of the center plate CP. Three lock holes H1-H3 are spaced along the periphery to the left of the coupling CC and along the left hand curved edge of the center plate CP aside from the flat bottom edge FE. The other three locking holes H4-H6 are spaced along the periphery to the right of the of the coupling CC and along the right hand curved edge of the center plate CP. Spaced away from the curved edge of the center plate CP and aside from the edged of the cable connection are two pivot holes PH aligned with the locking holes H1 and H6.

The handles BL/BR are assembled with the center plate CP by sliding the proximal ends of handles BL/BR into position with the opposing prongs PR of the forked clevis yokes FY on opposite sides of the center plate CP, and with fulcrum holes FH aligned with the respective pivot holes PH. Then the bolts B1 and B2 inserted through the fulcrum holes FH and pivot holes PH and the bolts are secured by the lock nuts, as indicated above. Each of the bolts B1 and B2 allows rotation of the connected handle BL or BR about the longitudinal axis thereof.

The clevis pins P1 and P2 can be inserted through respective holes LH and FH in the handles BL and BR and the center plate CP as the lock holes LH in the handles are aligned with selected ones of the six locating through holes H1-H6, each of which is adapted to receive a clevis pin P1/P2 such as the one shown in FIG. 1E.

Then, the handles BR and BL of the exercise bar EB are rotated into a position selected by the user at which the clevis pins P1 and P2 can be inserted through the lock holes LH and the ones of the locking holes H1-H6 selected by the user. Next, the hair pin cotters HC are inserted through the cotter holes CO in the ends of the clevis pins P1 and P2 as will be well understood by those skilled in the art. When the angles of the handles BR/BL of the exercise bar EB are to be adjusted, the hair pin cotters HC are removed briefly while the clevis pins P1/P2 are removed and handles BR/BL are adjusted to desired positions at which the pins P1/P2 are inserted into corresponding ones of the locking holes H1-H3 on the left and H4-H6 on the right. In summary, each of the handles BL/BR can be adjusted into desired ones of three angular positions relative to the center plate CP. Then the handles BL/BR can be locked into those positions by inserting the respective clevis pins P1/P2 into position as shown in FIG. 1A passing through lock holes LH in the handles BL/BR and locking holes H1 and H6 in the center plate CP. Each of the clevis pins P1/P2 is retained in position by a cotter pin, preferably including a quick release hair pin cotter HC of the type illustrated in FIG. 1F.

FIG. 1E shows an enlarged drawing of a clevis pin P1/P2 which is a fastener with a shaft SH having a large head HD on the right end and a cotter pin hole CO on the left end.

FIG. 1F shows an enlarged drawing of a conventional quick release hair pin cotter HC composed of steel spring wire, preferably made from hard drawn Medium Bessemer (MB) spring wire, zinc plated and baked or stainless type.

Figure 2:
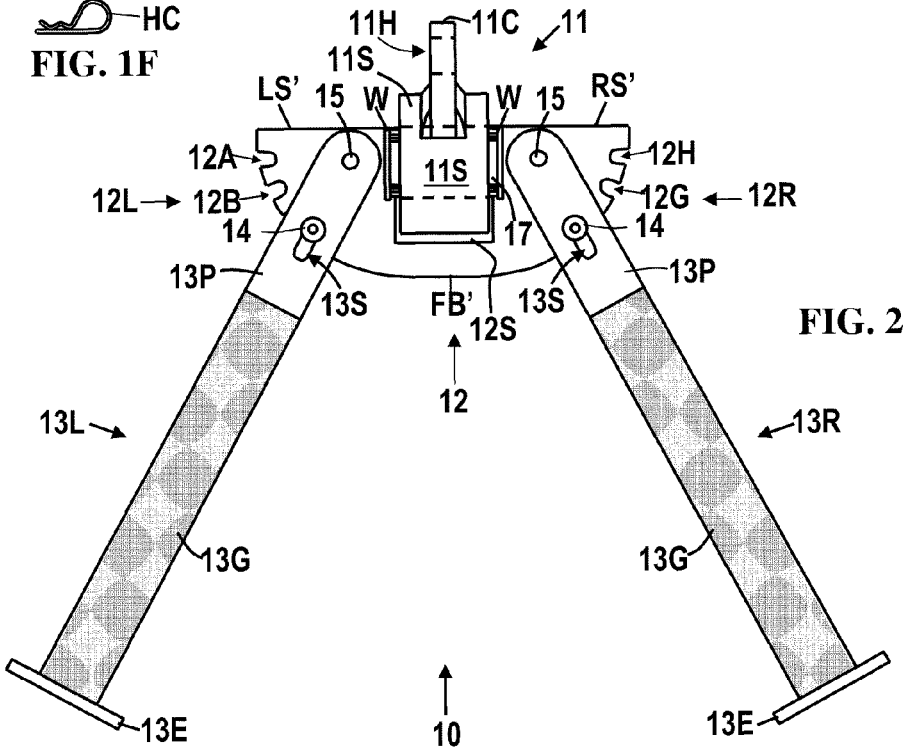
FIG. 2 is an elevational view of a second embodiment of an adjustable exercise bar in accordance with this invention including a coupling which supports a swing shaft.

FIG. 2 is an elevational view of an exercise bar 10 for pulling or pushing a cable including a second embodiment of the present invention. The exercise bar 10 includes a center plate 12 attached to a pair of left and right handles 13L/13R each of which is adjustable to four different angles relative to the center plate. As with the exercise bar EB of FIG. 1A, with the exercise bar 10 with shown in FIG. 2 there is no need to change, i.e. replace or remove, the exercise bar 10 from attachment to the cable of an exercise machine to reset the angle of each of the handles 13L/13R. Each of the handles 13L/13R on the exercise bar 10 can be adjusted to one of four positions while continuing the process of exercising by handle locating means as described below. The present invention eliminates the need to change exercise bars when going from one angle of the handles to another angle on an exercise bar 10, thus saving the athlete time.

Because the angle of the left handle 13L and the right handle 13R can be changed quickly in the both of the embodiments of FIGS. 1A and 2, attachment to a lat machine of either the exercise bar EB of FIG. 1A or the exercise bar of FIG. 2 in accordance with the present invention gives an athlete the benefit of maintaining substantially constant tension on the muscle being exercised, which is also recognized as a benefit by experts in the exercise field.

Figure 12:
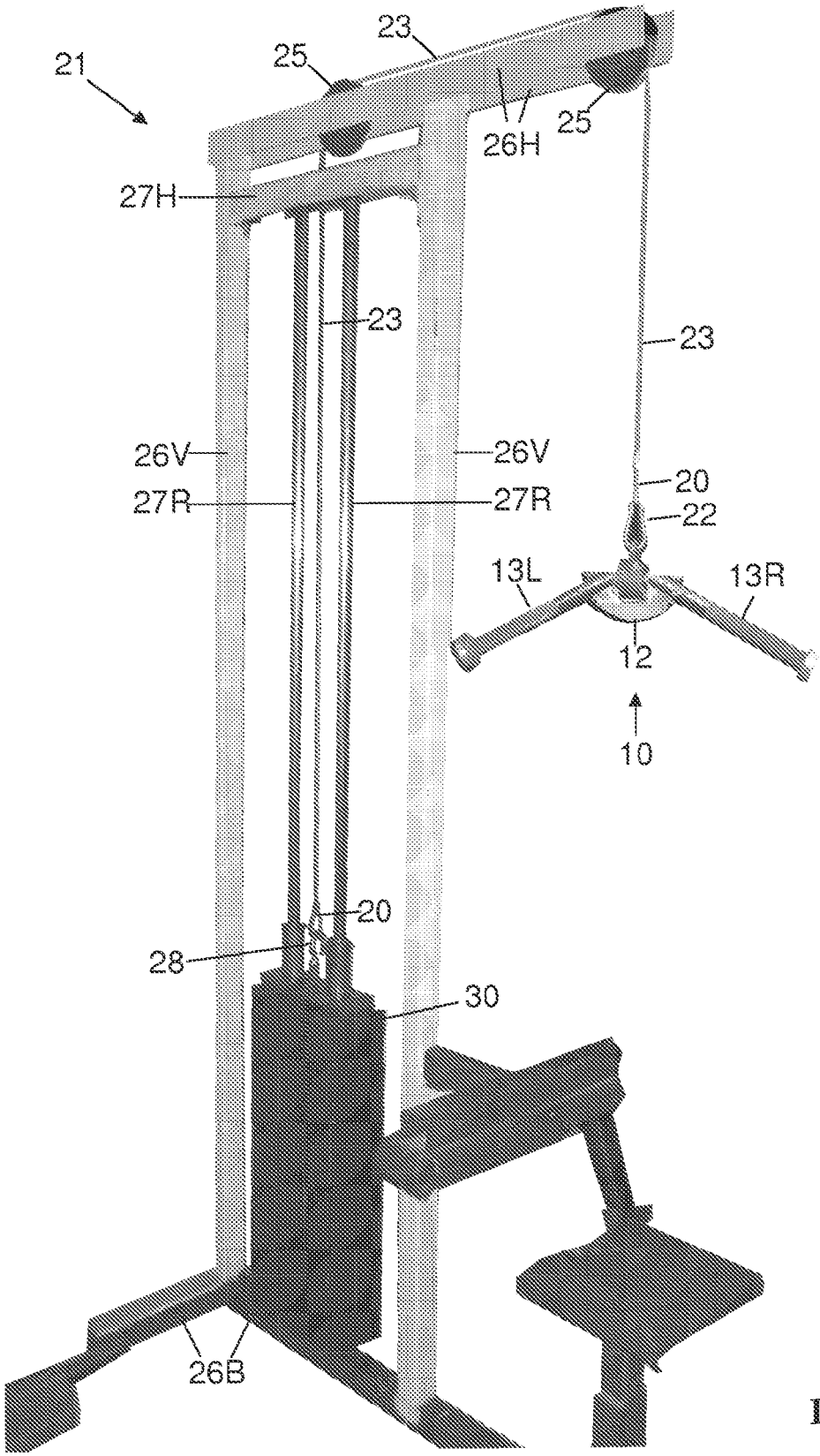
FIG. 12 is a partially photographic view of an exercise stations including a cable operated weight machine with a two handle exercise bar in accordance with this invention coupled to the cable of the machine.

The adjustable exercise bar 10, which can pull or push an exercise cable such as the main cable 23 shown in FIG. 12, includes a flexible coupling 11 projecting from the top center of the center plate 12, a swing shaft 17 which has been inserted inside a swing bearing hole 11B through the coupling 11 (shown in FIG. 4A), with the center plate 12 welded to the swing shaft 17 by welds W. Handles 13L/13R are secured at pivot points to the center plate 12 by spring pins 15. The center plate 12 is free to swing back and forth on the swing shaft 17 below the flexible coupling 11, while the entire exercise bar 10 can swivel left and right about the main cable 23 in FIG. 12.

Center Plate

Figure 3A:
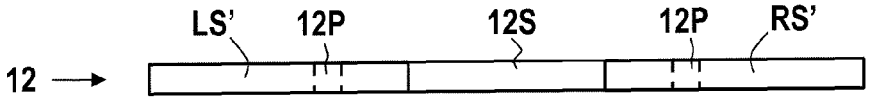
FIG. 3A is a top view of center plate of FIG. 2.
Figure 3B:
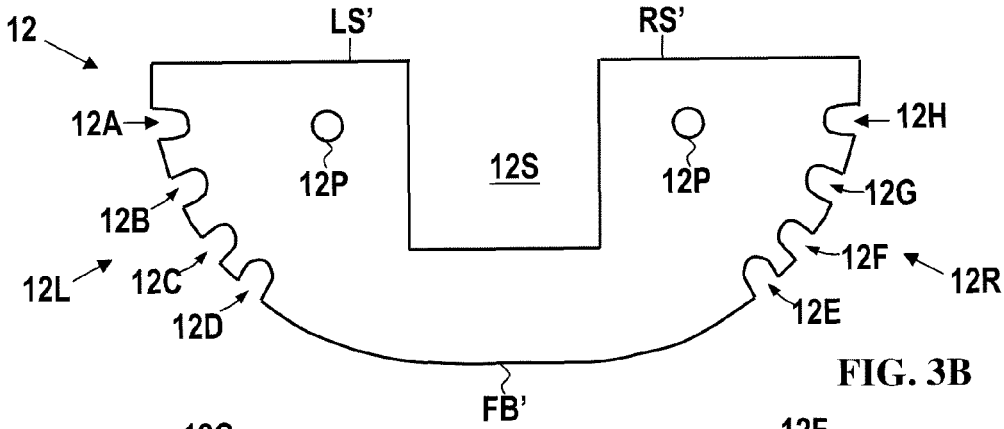
FIG. 3B is a front view of the center plate of FIG. 2.
Figure 3C:
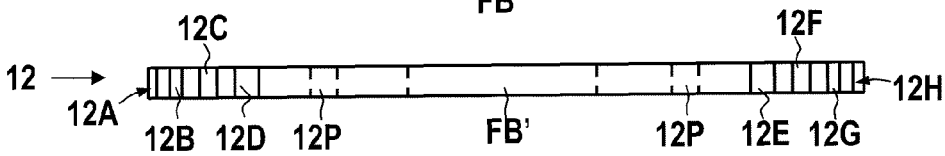
FIG. 3C is a bottom view of center plate of FIG. 2.
Figure 6:
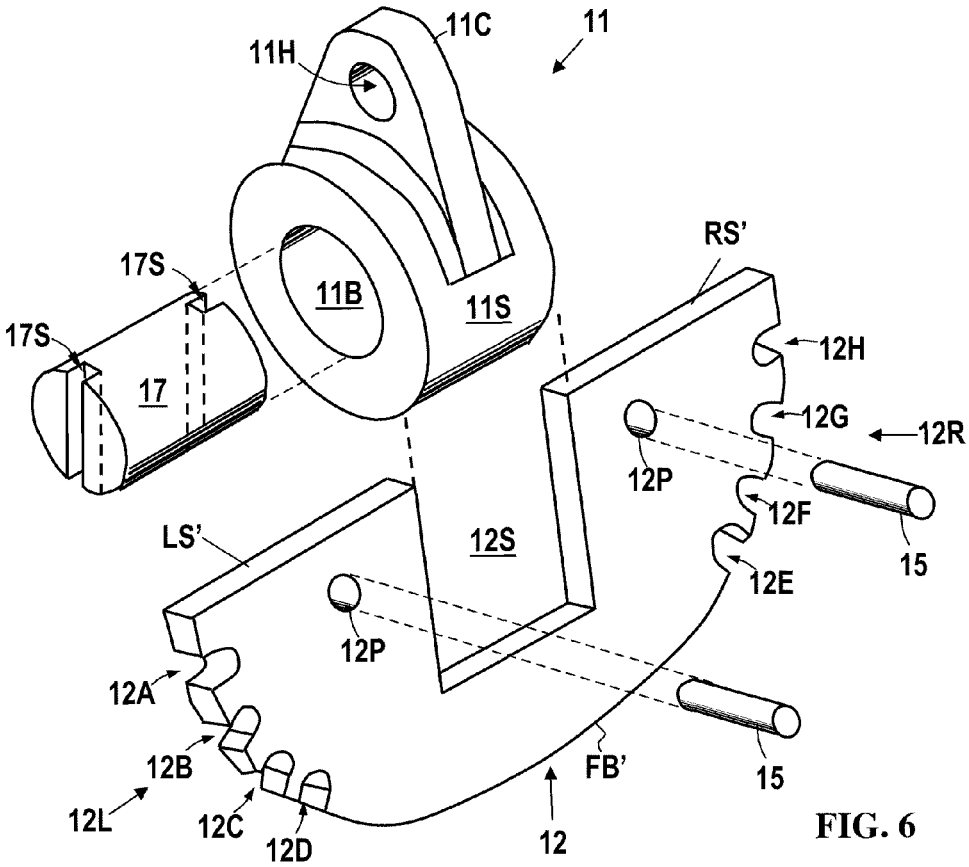
FIG. 6 is an exploded perspective view of the center plate of the adjustable exercise bar of FIGS. 2, and 3A-3C, the coupling and swing bearing of FIGS. 2, 4A and 4B, the swing shaft of FIGS. 2, 5A, and 5B and a pair of pivot spring pins of FIG. 2.

FIGS. 3A-3C show top, front and bottom views respectively of the center plate 12 of FIGS. 6, 7A-7C, 9, 10A-10D and 11A which interconnects elements of the exercise bar 10 of FIG. 2 including the swing shaft 17 and the handles 13L/13R. FIG. 6 shows the center plate 12 in a perspective view. As shown in those drawings, the center plate 12 has a partially circular left edge 12L and a partially circular right edge 12R, a left top edges LS', a right top edge RS' forming shoulders and a slot 12S extending down between the left top edge LS', and the right top edge RS'. A housing slot 12S is formed in the top of the center plate 12 between the left top edge LS', and the right top edge RS. The housing slot 12S is provided to house the swing bearing 11S of the flexible coupling 11 and the swing shaft 17. The swing shaft 17 is welded to the center plate 12 along the edges of the housing slot 12S, as explained in more detail below.

Figure 4A:
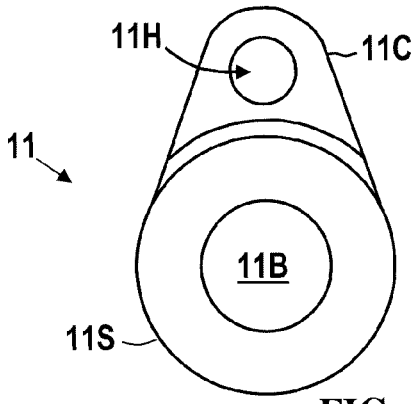
FIG. 4A is a left view of the coupling and swing bearing of FIG. 2.
Figure 4B:
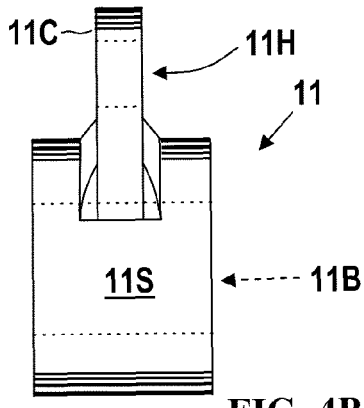
FIG. 4B is a front view of the coupling and swing bearing of FIGS. 2 and 4A.
Figure 5A:
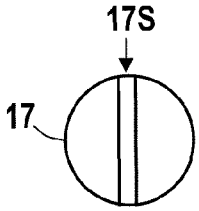
FIG. 5A is a left side view of the swing shaft of FIG. 2.
Figure 5B:
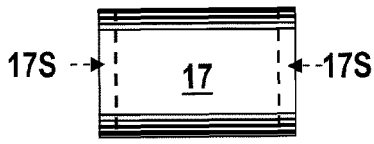
FIG. 5B is a front view of the swing shaft of FIGS. 2 and 5A.

FIG. 3A shows is a top view of the center plate 12 and with a housing slot 12S in the top center thereof for housing and the swing shaft 17 shown in FIGS. 5A and 5B and the coupling 11 including the swing bearing 11S of the flexible coupling 11 which are shown in FIGS. 4A and 4B. The flat upper edge of the center plate 12 comprises a left shoulder LS' and a right shoulder RS' split by the housing slot 12S in the top of the center plate 12 which is provided for housing the swing bearing 11S of the coupling 11 and the swing shaft 17. Two, bilateral spring pin pivot holes 12P are shown in phantom aside from the housing slot 12S.

Figure 8A:
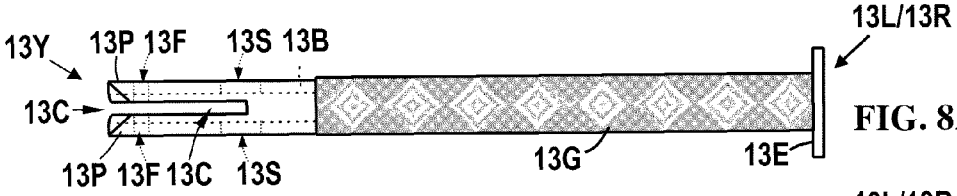
FIG. 8A is a plan view, i.e. a top view, of the adjustable exercise handle of with the two forks of the handle having a transverse cut therebetween with a coaxial bore therein for a biasing spring.

FIG. 3B is a front elevational view of the center plate 12 of FIGS. 2, 6, 7A-7C, 9, 10A-10D and 11A which has a left side edge 12L and a right side edge 12R which are circular segments centered on a bilateral pair of pivot holes 12P, plus a flat bottom edge FB', and a flat upper edge, split by a housing slot 12S between the pivot holes 12P. The flat upper edge comprises a left shoulder LS' and a right shoulder RS'. The housing slot 12S between the left shoulder LS' and the right shoulder RS' in the upper center of the center plate 12 provides the space for housing the swing shaft 17 and the flexible coupling 11. In addition, to permit adjusting the angles of the handles 13L/13R there are two, bilateral sets of openings which comprise handle locating means in the form of locating notches or locating detents 12A-12H formed in the left and right side edges 12L/12R of the center plate 12 for temporarily retaining, the left and right handles 13L/13R in selected, manually adjustable positions. On the circular left edge 12L of the center plate 12, there are four locating notches or locating detents 12A-12D and there are an additional four locating notches or locating detents 12E-12H in the right edge 12R of the center plate 12. The bilateral spring pin pivot holes 12P are provided to house the pivot spring pins 15 which provide pivots permitting rotation of the handles 13L/13R of the adjustable exercise bar 10 into alignment of each of a pair of locking pins 14 with the selected ones of the locating notches 12A-12H. Each locking pins 14 comprises a pair of shoulder bolts 14B/14B' threaded together at 14T as shown in FIG. 8C. Each pair of joined shoulder bolts 14B/14B' includes a pair of shoulder bolt heads BH extending outside the handles 13L/13R provided to permit manual withdrawal of the locking pin 14 into the handle 13L/13R from a locking position as shown in FIGS. 11B-11D in order to change positions of the handles 13L/13R relative to the center plate 12. In the locked position one of the locating notches 12A-12D on the left of center plate 12 retains the left handle 13L in a selected one of four positions, until released by pressing the corresponding locking pins 5 14 out of the notch by pressing on the shoulder bolt head BH of the locking pin 14 thereby compressing its compression spring 18. Similarly, in the locked position a notch 12E-12H on the right side of the center plate 12 retains the right handle 13R in a selected one of four positions, until released by pressing the corresponding locking pins 14 out of the notch by pressing on the shoulder bolt heads BH of the locking pin 14 thereby compressing its compression spring 18.

FIG. 3C is a bottom view of the center plate 12 of FIGS. 2 and 3A showing the handle locating means comprising notches 12A-12D on the left, locating notches 12E-12H on the right, the bottom edge FB' pivot holes 12P in phantom aside for the housing slot 12S which is also shown in phantom.

Figure 8B:
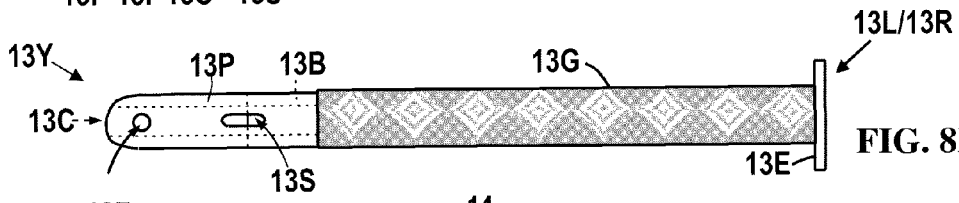
FIG. 8B shows a front view, i.e. an elevational view, of the adjustable exercise handle of FIGS. 2 and 8A with a transverse slot for the biasing pin and a through hole for a spring pin dowel to provide a pivotal attachment of the handle to the center plate of the adjustable bar.
Figure 8C:
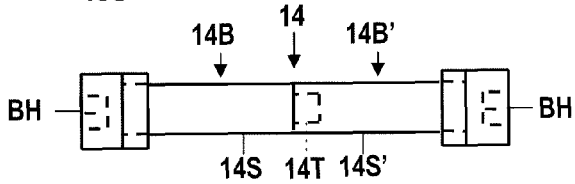
FIG. 8C is a side view of the double headed lock pin of the kind shown in FIGS. 2, 9, 10A-10D and 11B-11D which is shown assembled into the adjustable exercise handles of FIGS. 8A and 8B as shown in FIGS. 2, 10A-10D and 11A.
Figures 9, 13, 14, 15:
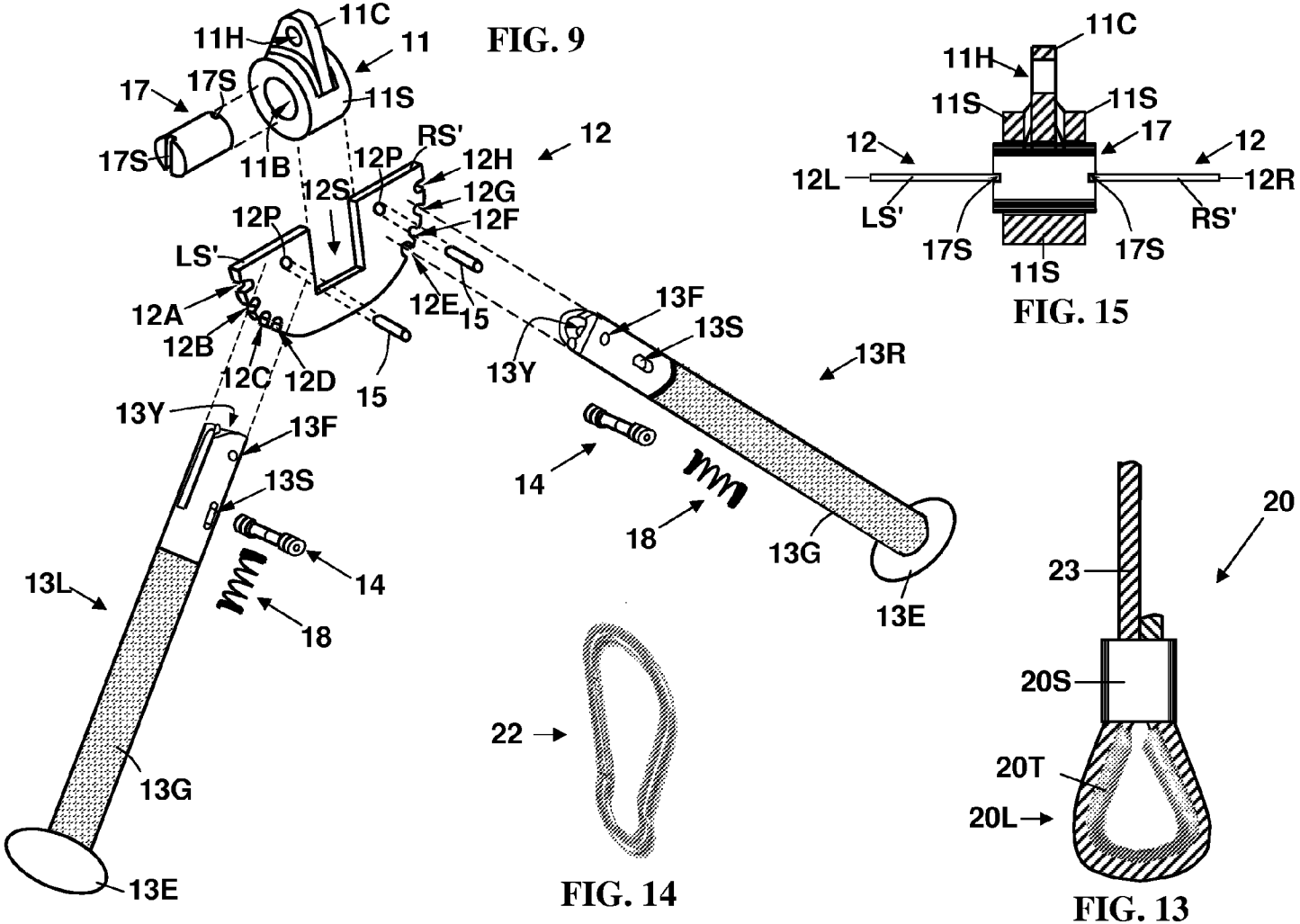
FIG. 9 is an exploded perspective view of the elements of the adjustable exercise bar of FIG. 2.
FIG. 13 shows a wire loop connector of the kind shown in FIG. 12 for connection of the adjustable handle in accordance with this invention to an exercise cable and for interconnecting the two wire cables shown in FIG. 12.
FIG. 14 shows a spring snap hook adapted for connecting the adjustable handle of this invention to the wire loop connectors of FIG. 13.
FIG. 15 is a partially sectional top view of the shaft of FIG. 11A showing the swing shaft of FIGS. 5A and 5B assembled with the coupling and swing bearing of FIGS. 4A and 4B and the swing shaft inserted into the slot in the top of the center plate of FIGS. 3A-3C.

Referring again to FIG. 3B and to FIGS. 6, 8B and 9 the center plate 12 with its bilateral sets of locating notches 12A-12H formed in the periphery thereof includes the four left locating notches 12A-12D and the four right locating notches 12E-12H. All of the locating notches 12A-12H are located in the partially circular side edges 12L/12R of the center plate 12. The locating notches 12A-12D are provided for retaining the left handle 13L in position relative to the center plate 12; and the four additional locating notches 12E-12H are provided for retaining the right handle 13R in position relative to the center plate 12. The mechanism for locking for the left and right handles 13L/13R in position will be explained in more detail below with reference to the handles 13L/13R and the kind of locking pin 14 shown in FIGS. 11B-11D.

Coupling

The flexible coupling 11 of FIG. 2 is shown in detail in FIG. 4A, which is a left side view and FIG. 4B which is a front view thereof. FIG. 6 shows the flexible coupling 11 in a perspective view. A cylindrical swing bearing 11S on the bottom is the cylindrical main body of the flexible coupling 11. The cylindrical main body 11S includes a concentric a cylindrical swing bearing hole 11B extending through the swing bearing 11S which is provided for housing the swing shaft 17. When the swing shaft 17 is inserted through the swing bearing hole 11B it provides support for the center plate 12 which can swing back and forth thereon. A cable connection 11C with a hook hole 11H therethrough projects from the top of the swing bearing 11S of the coupling 11. The hook hole 11H is provided for connection of the center plate 12 of FIG. 2 to an exercise cable such as the weight 5 lifting cable 23 of FIG. 12.

Swing Shaft

FIGS. 5A and 5B show the swing shaft 17 of FIG. 2 in detail. FIG. 5A is a left side view of the swing shaft 17 and FIG. 5B is a front view thereof. FIG. 6 shows the swing shaft 17 in a perspective view. The flat ends of the swing shaft 17 have alignment slots 17S formed therein as shown in FIGS. 5A, 5B, 6, 9 and 11A. Thus, when the swing shaft 17 and the flexible coupling 11 are assembled with the center plate 11, the ends of the swing shaft 17 fit inside the edges of the housing slot 12S in the center plate 12. In FIG. 2, the swing shaft 17 which is supported by the flexible coupling 11 is shown inserted into housing slot 12S FIG. 2 with the slotted ends 17S of the swing shaft 17 overlapping the edges of the housing slot 12S in the center plate 12 which are partially inserted into the alignment slots 17S as shown in FIGS. 7A-7C.

Figures 11A, 11B, 11C, 11D, 11E:
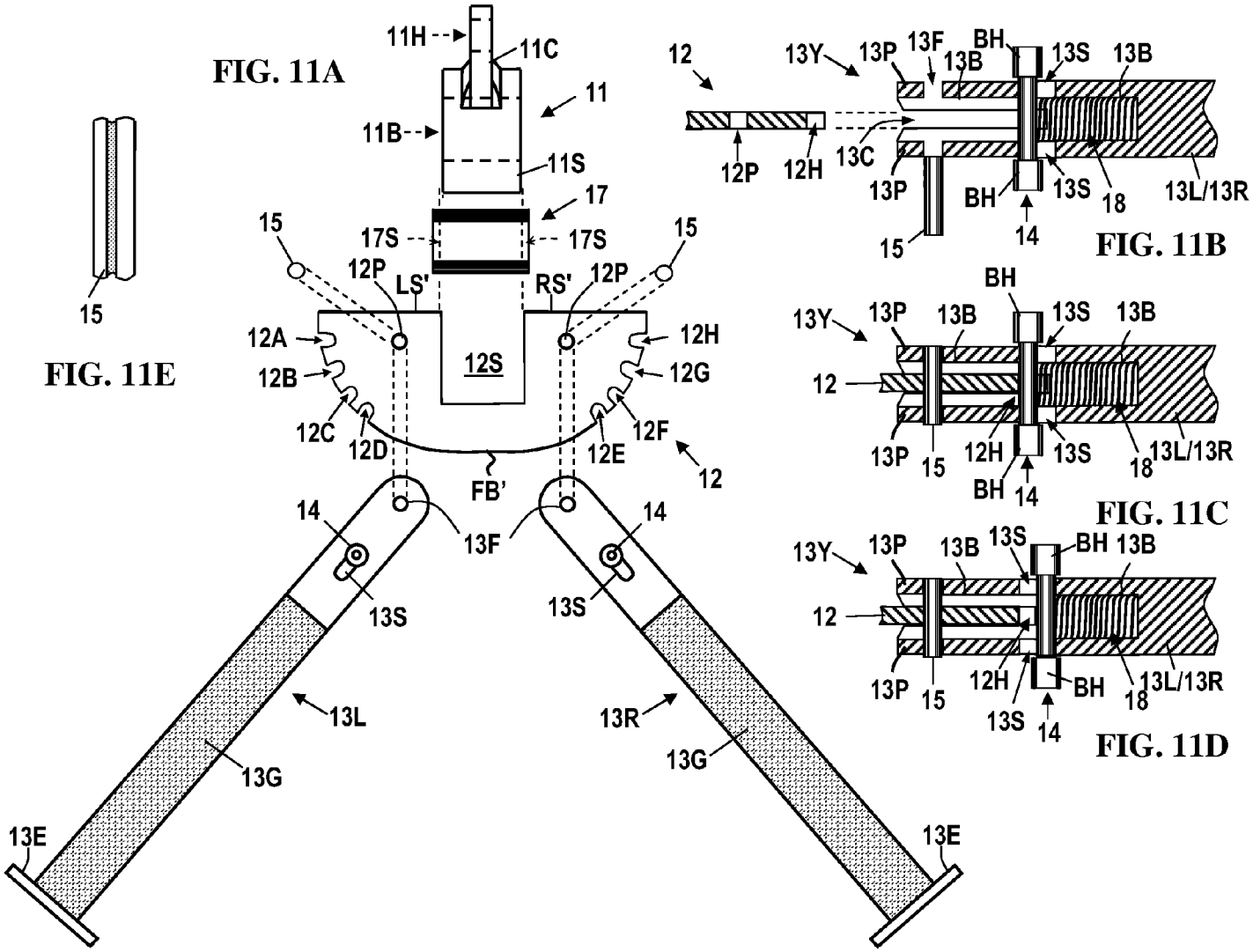
FIG. 11A is an exploded front view of adjustable exercise bar view of the exercise bar of FIG. 2 with adjustable angle handles as shown in FIGS. 10A-10D.
FIG. 11B is a fragmentary, sectional side view of the proximal end of a handle as shown in FIGS. 2 and 11A with a spring pin adjacent to fulcrum holes in two prongs at the proximal end of the handle and with the edge of the center plate aligned to be inserted into the a slot between those prongs and with a locating notch in the periphery of the center plate aligned to receive the double headed locking pin which is driven into locking position by the compression spring.
FIG. 11C is a sectional side view of the proximal end of the handle of FIG. 11B with the handle and the center plate assembled and with a spring pin inserted through the fulcrum holes in the handle and the pin hole in the center plate and with the lock pin inserted into a locating notch in the periphery of the center plate.
FIG. 11D is a modification of the sectional side view of the proximal end of the handle of FIG. 11C with the lock pin withdrawn from the locating notch in the center plate by compressing the compression spring to permit rotation of the handle about the center plate.
FIG. 11E is an enlarged sectional side view of a spring pin adapted for insertion through the fulcrum holes in the handle of FIGS. 11A-11D and through the pivot hole through the center plate of FIGS. 2, 3A-3C and 7A-7C, etc.

FIG. 6 is an exploded perspective view of the flexible coupling 11, the swing shaft 17, the center plate 12, and the pivot spring pins 15 of FIG. 2, illustrating how they are assembled. The swing shaft 17 is aligned for insertion into the swing bearing hole 11B of the swing bearing 11S prior to welding of the shaft to the center plate 12 along the edges of a housing slot 12S therethrough. The swing shaft 17 is inserted into the swing bearing hole 11B followed by sliding the swing shaft 17 and the coupling down into the slot 12 of the center plate 12. Next weld the swing shaft 17 to the center plate 12 along the edges of housing slot 12S in center plate 12 and along the ends of the swing shaft 17. After the handles 13L/13R have been assembled with the center plate 12, the pivot spring pins 15 of FIGS. 2 and 11E are driven through the prong fulcrum holes 13F in the proximate ends of the handles 13L/13R and the pivot holes 12P as will be described in more detail below.

Figure 7A:
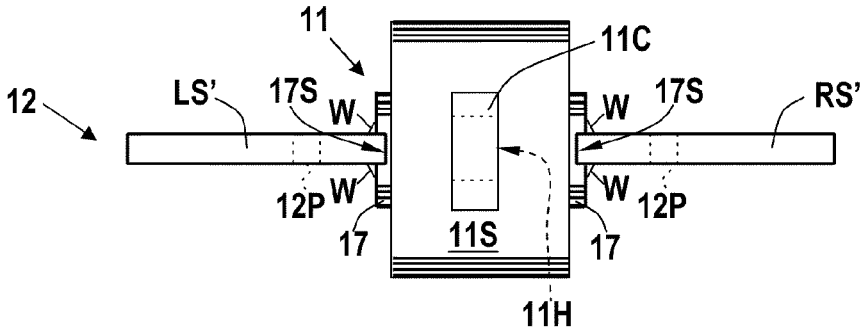
FIG. 7A shows a top view of the assembly of the coupling and swing bearing, the swing shaft and the center plate of FIGS. 2, 3A, 3B, 3C, 4A, 4B, 5A and 5B.
Figure 7B:
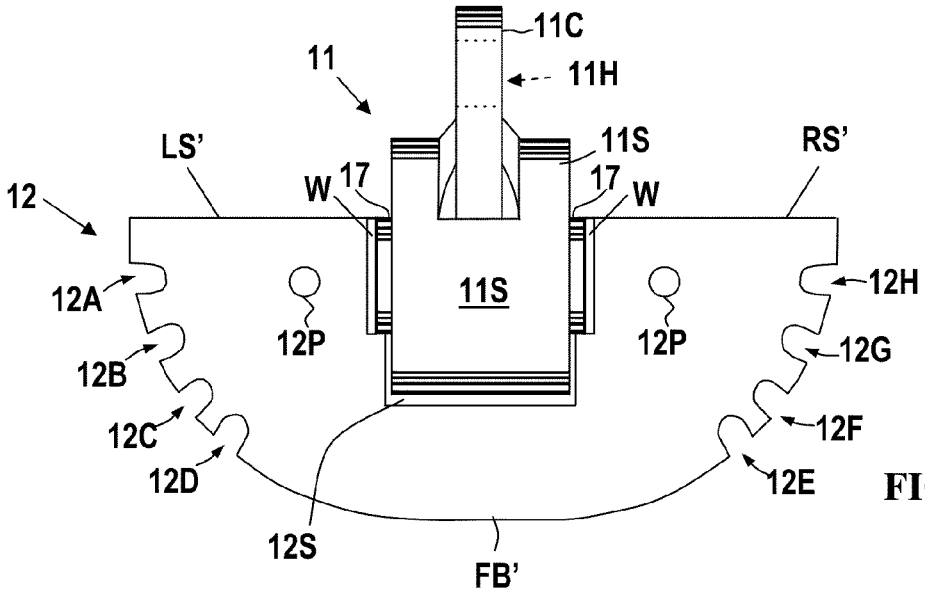
FIG. 7B shows an elevational view of the assembly of the coupling, the swing shaft and the center plate of FIG. 7A.
Figure 7C:
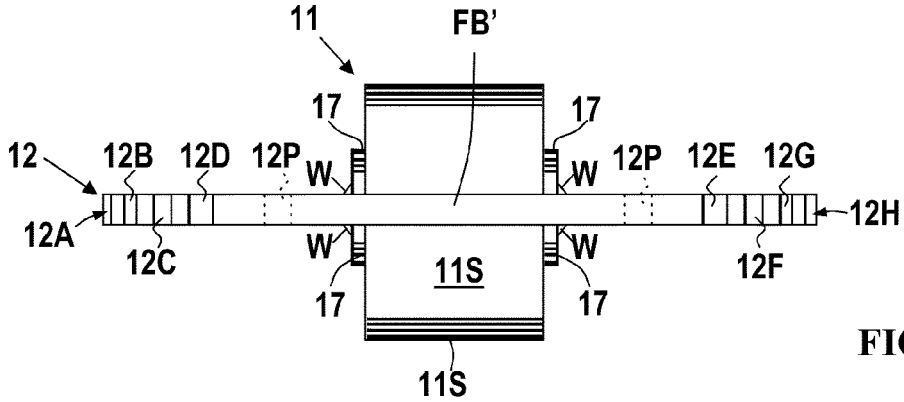
FIG. 7C shows a bottom view of the assembly of the coupling, the swing shaft and the center plate of FIGS. 7A and 7B.

FIGS. 7A-7C show top, elevational and bottom views of the assembly of the flexible coupling 11, the swing shaft 17 and the center plate 12. In each view the welds W of the swing shaft 17 to the center plate 12 are shown. As indicated above, the top edges of the alignment slot 17S in the swing shaft 17 are shown. The space between the borders of the swing bearing 11S and the edges of the housing slot 12S in the center plate 12 make it clear that the center plate 12 and the swing shaft 17 are free to swing back and forth under the flexible coupling 11.

FIG. 8A shows a plan view of the generally cylindrical knurled handle 13L of FIG. 2 which is identical to handle 13R in FIG. 2. The proximate end of handle 13L includes a forked yoke BY with two prongs 13P formed by a longitudinal, transverse, cut 13C between the two prongs 13P extending through the longitudinal axis of the bore hole 13B and the handle 13L. The handle 13L includes a coaxial bore 13B in the proximate end thereof for housing the compression spring 18 (shown in FIGS. 11B-11D.). The compression spring 18 is wound about its axis forming a helix which opposes spring compression along the axis about which the helix is wound. Further discussion of the compression spring 18 is found below in connection with a description of FIGS. 11B, 11C, and 11D. A pair of prong fulcrum holes 13F are formed in the proximate ends of the prongs 13P of each handle 13L/13R, which are provided to receive a pivot spring pin 15 after the prongs 13P are positioned with the prong fulcrum holes 13F on opposite ends of the pivot spring holes 12P. In addition there is a transverse lock hole 13S in the handle 13 (which is shown in phantom) through which the locking pin 14 or 14 is to be inserted. For safety, a disk shaped handle end BE is formed on the end of the handle 13L/13R to prevent the handle from slipping out of the hand of the user; and the exterior surfaces thereof are knurled between the distal end of bore 13B and the handle end BE to enhance the ability of the user to grip the handles 13L/13R.

FIG. 8B is an elevational view of the handle 13 of FIG. 8A showing a pair of prong fulcrum holes 13F extending through one of the prongs 13P for housing one of the pivot spring pins 15 of FIGS. 2, 6, 9 and 11B-11E. The transverse lock hole 13S for a locking pin 14 or 14 is shown aligned with the spring pin through the prong fulcrum holes 13F and centered over the longitudinal axis of the bore hole 13B and the handle 13L. In FIG. 8B the coaxial bore 13B, which is shown in phantom is provided to house the helical biasing spring 18, shown in FIG. 9 and FIGS. 11B, 11C and 11D, which is preferably a century spring.

Double Headed Locking Pins

Referring to FIGS. 8A, 8B, 8C and FIGS. 11B-11D, each of the handles 13L/13R is retained in one of four normally locked positions when the locking pin 14 therein shown in FIG. 8C with double heads DH is driven by a compression spring 18 shown in FIGS. 9 and 11B-11D into a normally locked position within a selected one of the locating notches 12A-12H. FIG. 8C is a side view of the double headed lock pin of the kind shown in FIGS. 2, 9, 10A-10D and 11B-11D which is shown assembled into the adjustable exercise handles of FIGS. 8A and 8B as shown in FIGS. 2, 10A-10D and 11A. As shown in FIG. 8C the double headed locking pin 14 is formed by two joined shoulder bolts 14B and 14B' with heads BH. Bolt 14B is formed with a male shaft 14S. Bolt 14B' is formed with a female shaft 14S' with bolts 14B/14B' fastened together. In other words, shaft 14S of the shoulder bolt 14B is male threaded and shaft 14S' a coaxial bore hole in the shoulder bolt 14B' is female threaded with the male threads of the shaft 14S joined to the female threaded coaxial bore hole in female shaft 14S'. The combined shaft 14S/14S' of a locking pin 14 is manually withdrawn from a locating notch 12A-12H by manual pressure applied by the user or an assistant to the heads BH of the locking pin 14. Otherwise the locking pin 14 is retained in a locked position under pressure from the compression spring 18. There are four locating notches 12A-12D in the circular left edge 12L of the center plate 12 and there are an additional four locating notches 12E-12H in the right edge 12R of the center plate 12, which are shown in FIGS. 3, 5B, 8B and 9 which retain each of the handles 13L/13R in a selected one of four positions, until released by pressing the corresponding locking pins 14 out of the notch by compressing the compression spring 18.

The left handle 13L and the right handle 13R are secured to the left and right sides of the center plate 12 respectively by the pivot spring pins 15 (illustrated in FIG. 11E,) which pivot spring pins allow the left and right handles 13L/13R to pivot thereon about the respective left and right edges 12L and 12R of the center plate 12. Referring to FIG. 11E, the pivot spring pins 15 comprise split dowels or split tubes of spring steel with a marginally larger diameter than the hole into which they are to be inserted. In this case each of the pivot spring pins 15 is inserted into both one of the pivot holes 12P (shown in FIGS. 3A-3C, 6, 8A-8C, 9, 11A and 11B) and a set of prong fulcrum holes 13F (shown in FIGS. 4A, 4B, and 11B) in the bilateral prongs 13P in the proximal ends of the handles 13L/13R. In short, the pivot spring pins 15 are inserted through the pivot holes 12P and the prong fulcrum holes 13F in the handles 13L/13R shown in FIGS. 4A, 4B, 9, 11A and 11B. One or both of the spring pins 15 is shown in FIGS. 3, 9, 10A-10D, and 11A-11E.

FIG. 9 is an exploded perspective view of the elements of the exercise bar 10 including the center plate 12, the flexible coupling 11, the swing shaft 17 with alignment slots 17S. When being assembled, the swing shaft 17 is rotated into alignment for insertion into the bearing hole 11B in the flexible coupling 11 with the alignment slots 17S aligned with the edges of the housing slot 12S in the center plate 12, between the left shoulder LS' and the right shoulder RS'. Then the swing shaft 17 is welded to the center plate 12 with welds W shown in FIGS. 2, 7A-7C, and 10A-10D to support the center plate 12 so that it can swing, i.e. pivot below the flexible coupling 11.

FIGS. 10A-10D are elevational views are shown of the exercise bar 10 of FIG. 2 with the two handles 13L/13R adjusted into four different angular positions with respect to the center plate 12 by rotation about the center plate 12 on the spring pins 15 to a selected position. As indicated above, each of the handles 13L/13R is normally locked into a selected fixed position about the left and right circular side edges 12L/12R with the shafts 14S/14S' of one of the corresponding one of the locking pins 14 on the left and right respectively biased by a compression spring 18 into one of the locating notches 12A-12H. As indicated above, the shafts 14S/14S" of each locking pin 14 is released from one of the locked position by manual release pressure exerted on the shoulder bolt heads BH of the locking pin 14 to disengage the shafts of the shoulder bolts 14S/14S" of that locking pin 14 from a locating notch 12A-12H in which it has been engaged. In the absence of application of manual release pressure the locking pin 14 and/or 14 is in contact with the edge of the center plate 12 and when in position it is retained in one of four locked positions engaged in one of the locating notches 12A-12H by spring biasing pressure exerted by the compression spring 18. The operation of the compression spring 18, the locking pins 14 and the engagement thereof in the locating notches 12A-12H and disengagement therefrom will be described in more detail below with reference to FIGS. 11B, 11C and 11D.

Figure 10A:
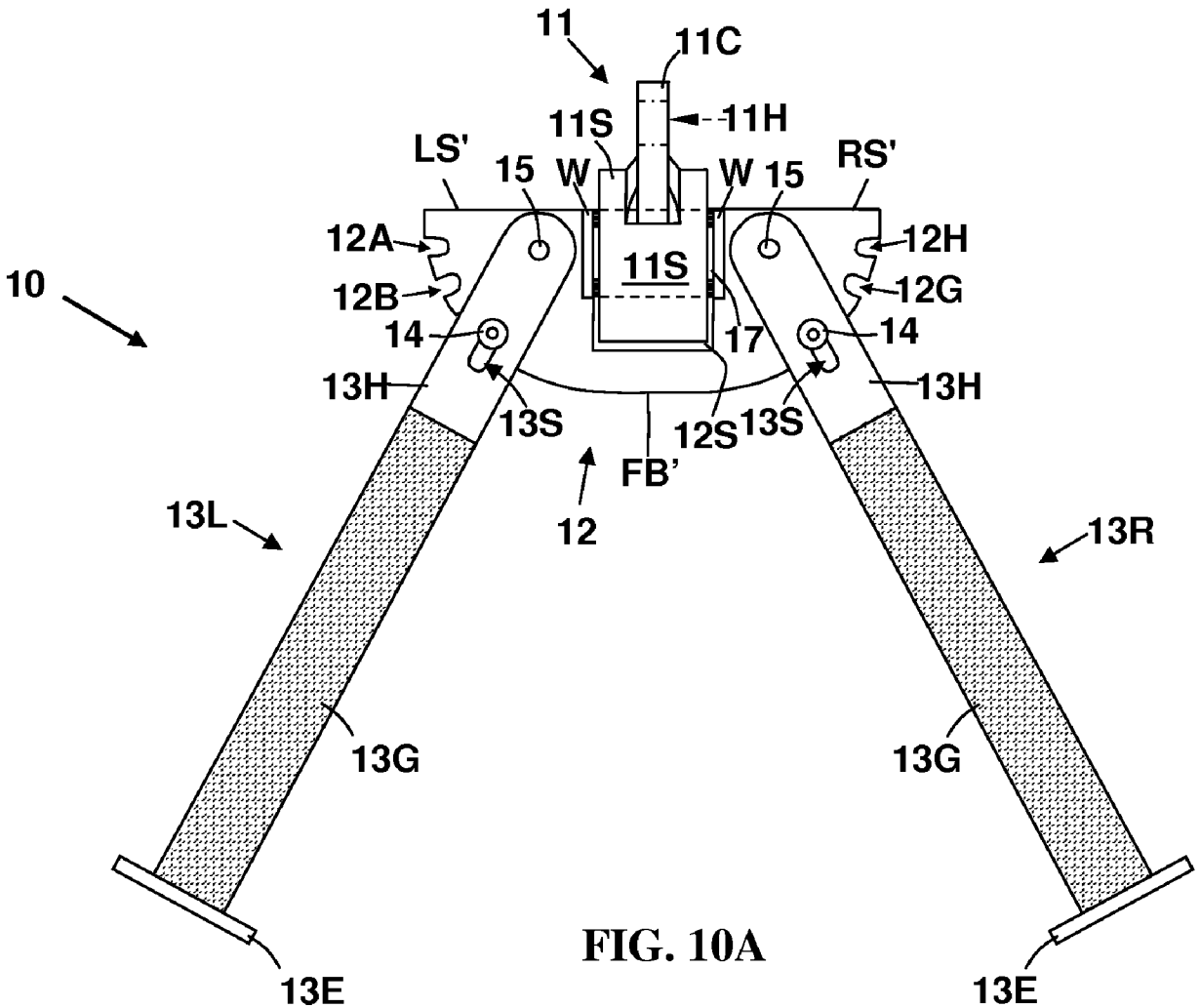
FIG. 10A is an elevational view of the exercise bar of FIG. 2 with the locking pins locking the handles of the exercise bar in the lowest position on the center plate at an angle of about sixty degrees.

In FIG. 10A the exercise bar 10 of FIG. 2 is shown with the locking pins 14 locking the handles 13L/13R of the exercise bar 10 in the lowest position on the center plate 12 at an angle of about sixty degrees.

Figure 10B:
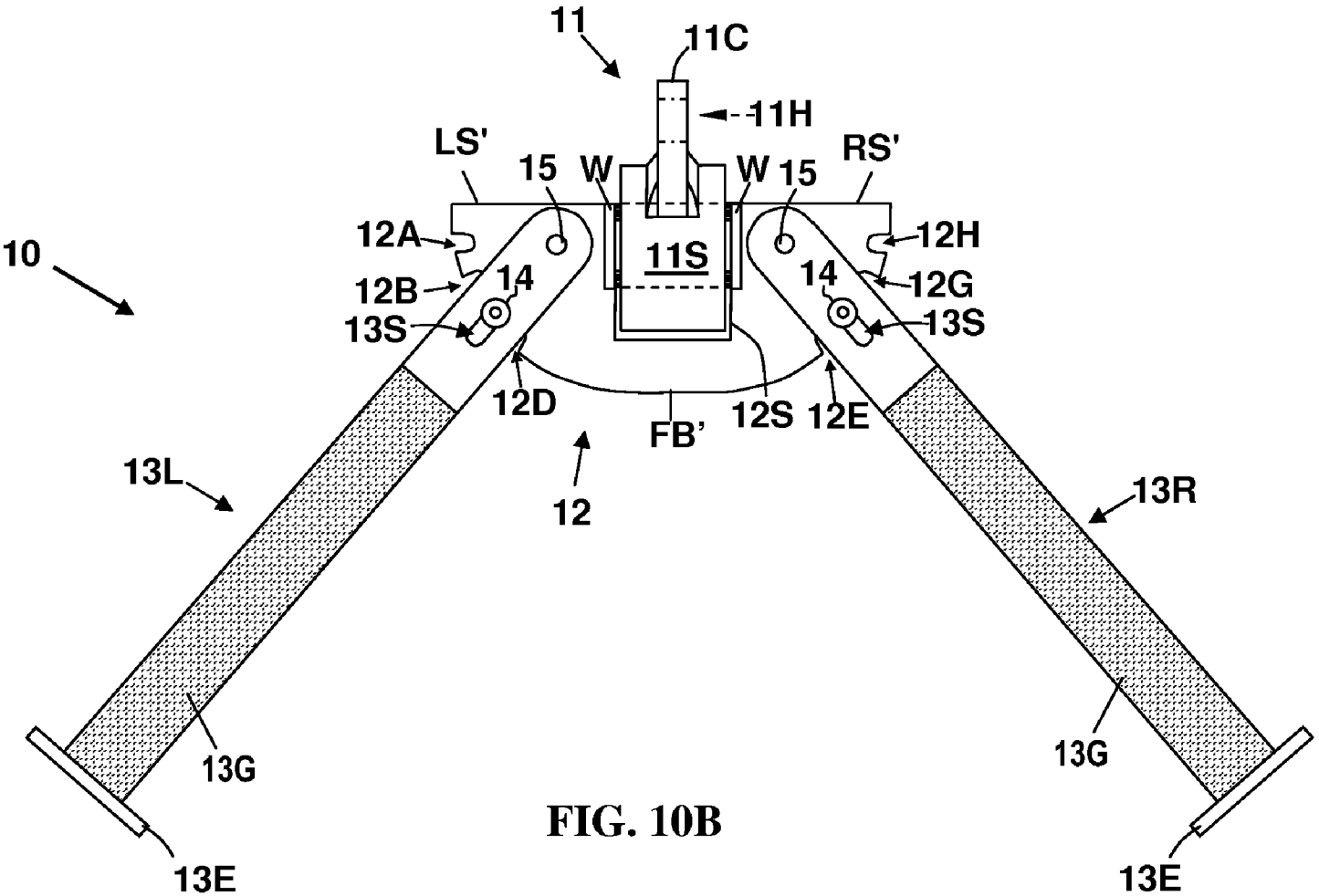
FIG. 10B is an elevational view of the exercise bar of FIG. 2 with the locking pins locking the handles of the exercise bar into the next to lowest position on the center plate at an angle of about forty-five degrees.

In FIG. 10B the exercise bar 10 of FIG. 2 is shown with the locking pins 14 locking the handles 13L/13R of the exercise bar 10 into the next to lowest position on the center plate 12 at an angle of about forty-five degrees.

Figure 10C:
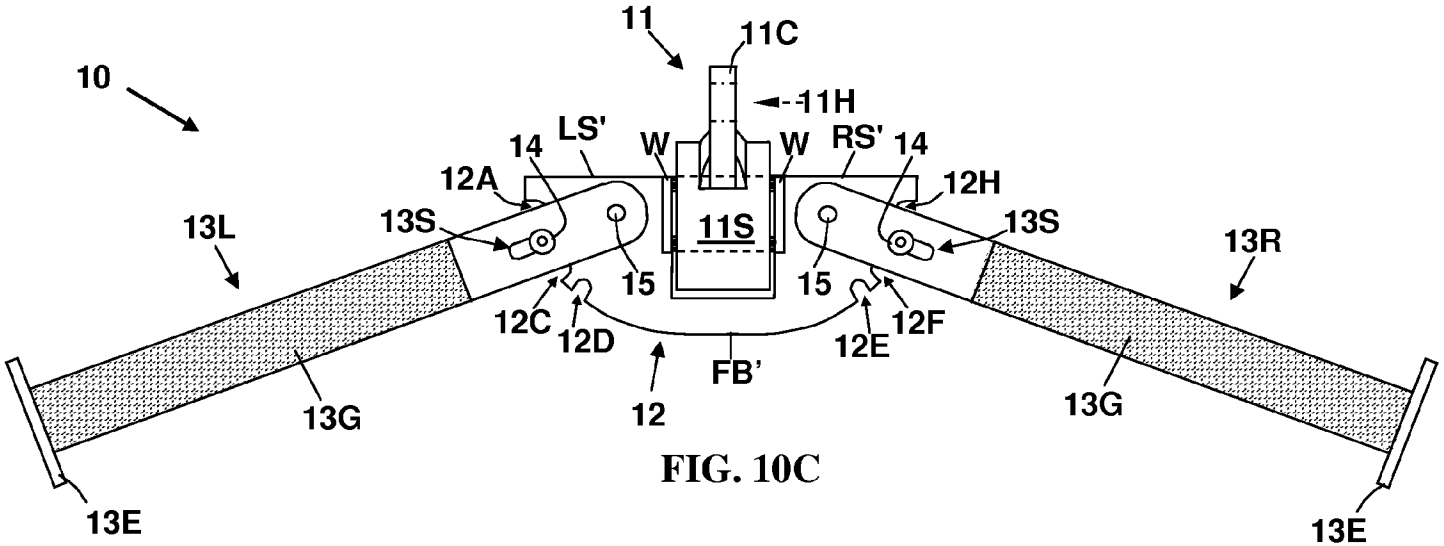
FIG. 10C is an elevational view of the exercise bar of FIG. 2 with the locking pins retaining the handles of the exercise bar into the next to highest position on the center plate at an angle of about twenty-five degrees.

FIG. 10C the exercise 10 bar 10 of FIG. 2 is shown with the locking pins 14 locking the handles 13L/13R of the exercise bar 10 into the next to highest position on the center plate 12 at an angle of about twenty-five degrees.

Figure 10D:
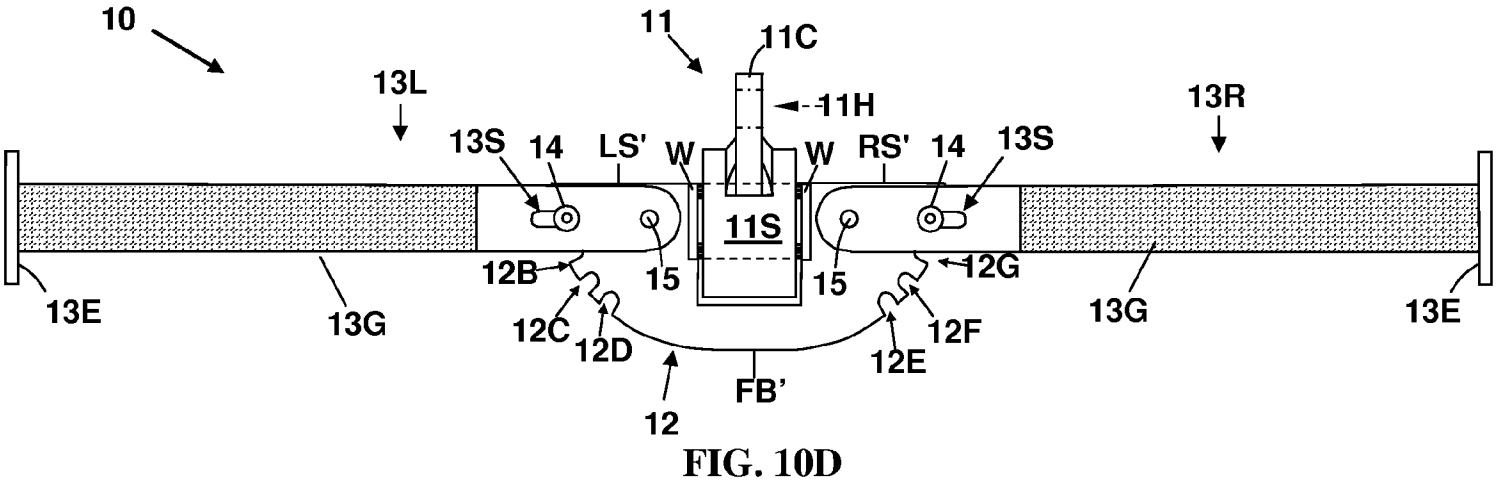
FIG. 10D is an elevational view of the exercise bar of FIG. 2 with the locking pins locking the handles of the exercise bar into the highest position on the center plate at an angle of approximately zero degrees.

In FIG. 10D the exercise bar of FIG. 2 is shown with the locking pins 14 locking the handles 13L/13R of the exercise bar 10 into the highest position on the center plate 12 at an angle of approximately zero degrees.

FIG. 11A is an exploded view of all of the elements of the exercise bar 10 including the center plate 12, the flexible coupling 11, the swing shaft 17 with it alignment slots 17S, the spring pins 15 and the handles 13L/13R. The swing shaft 17 is shown aligned for insertion into the housing slot 12S with the alignment slots 17S aligned with the edges of the housing slot 12S in the center plate 12, between the left shoulder LS' and the right shoulder RS'. The flexible coupling 11 is also shown aligned with the housing slot 12S. The handles 13L/13R are shown with the prong fulcrum holes 13F aligned below the respective pivot holes 12P. The pivot spring pins are shown above and aside from the center plate 12.

Referring to FIGS. 11B-11D, the handle 13L includes the coaxial bore 13B therein for housing a wound, compression spring 18 which pushes against the locking pin 14 opposing compression along the longitudinal axis of the helical of compression spring 18. Each of the two compression springs 18 in the two handles 13L/13R biases the respective locking pin 14 into position with its shaft 14S/14S' (shown in FIG. 8C) inserted into the selected ones of the locating notches 12A-12H. An exemplary locking pin 14 is shown in locked position in FIG. 11C with its shaft 14S/14S' inserted into notch 12H of the center plate 12. FIG. 11D shows the locking pin 14 retracted from the locked position with the notch 12H exposed. As stated above, each spring pin provides a pivotal attachment of one of the handles 13L/13R to the center plate 12 of the exercise bar 10. Referring to FIGS. 11C and 11D, each spring pin 15 is inserted through both prong fulcrum holes 13F through the prongs 13P and the pivot hole 12P in the center plate 12 to provide pivotal support for the handle 13L. Thus, each handle 13L/13R is free to rotate about the center plate 12 when the compression spring 18 therein is compressed by pressure on the corresponding locking pin 14. The handles are locked in a new position when pressure on the locking pins 14 is released so that they engage in and are locked into selected notches in the center 12 under spring-biased, pressure from compression springs 18.

As indicated above FIG. 8C shows a locking pin 14 which comprises a pair of shoulder bolts 14B/14B'; and the shoulder bolts 14B/14B' are permanently joined together by a threaded joint where the shafts 14S/14S' of the shoulder bolts 14B/14B are joined at joint 14T to form the locking pin 14. Each shoulder bolt 14B/14B' includes a pair of locking shoulder bolt heads BH extending outside the handles 13L/13R which are provided for application of manual pressure thereon for temporary withdrawal of the locking pin 14 into the coaxial bore hole 13B in the handle 13L/13R from a locking position as shown in FIGS. 11B-11D in order to change positions of the handles relative to the center plate 12. Upon removal of the manual pressure on the shoulder bolt heads BH, the locking pin is driven back into contact with the periphery of the center plate 12, which will lock the handle into position when the shaft of the locking pin 14 is lined up with one of the notches 12A-12H Referring again to FIG. 2, when the elements of FIG. 3 are assembled, the center plate 12 combined with the left and right handles 13L/13R can swing back and forth below the flexible coupling 11 during exercise by the user. In that case the center plate 12 and the swing shaft 17 can swing back and forth as the swing shaft 17 is welded by welds W to the center plate 12 after it has been inserted into the opening 11B in the flexible coupling 11. The welds W to the swing shaft 17 and the center plate 12 are formed adjacent to the housing slot 12S, but leave the flexible coupling 11 free thereof so that the center plate 12 and the swing shaft 17 can swing back and forth below the coupling 11.

The spring pins 15 provide pivotal attachment of the handles 13L/13R to the center plate 12 of the exercise bar 10 for rotation of each thereof about the axis of the spring pins 15 attached thereto. There are four settings to which one can adjust the handles 13L/13R on the exercise bar 10 in FIG. 2 while continuing the process of exercising. As with the exercise bar EB of FIG. 1A, the present invention eliminates the need to change bars when going from one angle of the handles on an exercise bar to another angle, thus saving the athlete time.

When a spring pin 15 is driven into a pivot hole 12P it is compressed and presses against the wall of the hole 12P creating a frictional locking grip. When a spring pin 15 is inserted through a prong fulcrum holes 13F through the handles 13L/13R as well as through the appropriate one of the pin holes 12P in the center plate, it is ready to serve as a pivot about which the left or right handle 13L/13R can pivot when it is being adjusted to a different position. Thus each of the two spring pins 15 serves as a pivot bearing for supporting the left or right handle 13L/13R for pivoting about the spring pin 15 on the center plate 12.

The swing shaft 17 is shown to be welded by welds W to the center plate 12 after the swing shaft 17 has been inserted into the opening 11B in the coupling 11 and the swing shaft 17 and the coupling have then been inserted into the housing slot 12S as shown in FIG. 2. As indicated above, the swing shaft 17 is provided to allow swinging thereof back and forth about the axis of the coupling 11. During assembly, the swing shaft 17 (provided to serve as a swing bearing) is inserted into the opening 11B in the coupling 11. Then the combination of the coupling 11 and the swing shaft 17 are both inserted into the housing slot 12S in the top surface of the center plate 12. In turn the edges of the swing shaft 17 are welded to the center plate 12 forming welds W so that the center plate 12 and the handles 13L/13R and the swing shaft 17 can swing back and forth below the coupling 11.

FIG. 11A is an exploded front view of adjustable exercise bar of FIGS. 2 and 6. FIGS. 11B-11D show sectional side view of the proximal end of a representative handle 13L.

FIG. 11B is a sectional side view of the proximal end of the handle 13L with a spring pin 15 adjacent to prong fulcrum holes 13F in two prongs 13P at the proximal end of the handle 13L and with the edge of the center plate 12 aligned to be inserted into the transverse slot 13C between prongs 13P and with a locating notch 12H in the periphery of the center plate 12 aligned to receive the locking pin 14. FIG. 11C is a sectional side view of the proximal end of the handle 13L of FIG. 11B with the handle 13L and the center plate 12 assembled and with spring pin 15 inserted through the fulcrum holes 13F in the handle and the pivot pin hole 12P in the center plate 12. The 14 lock pin is inserted into the locating notch 12H in the periphery of the center plate 12. FIG. 11D is a modification of the sectional side view of the proximal end of the handle 13L of FIG. 11C with the lock pin 14 withdrawn from the locating notch 12H in the center plate 12 to permit rotation of the handle 13L about the center plate 12.

FIG. 11E is an enlarged sectional side view of a spring pin 15 adapted for insertion into a pivot hole 12P in the center 12 through the prong fulcrum holes 13F in the one of the handles of FIGS. 11A-11D. FIG. 8C is a side view of the double headed lock pin of the kind shown in FIGS. 2, 9, 10A-10D and 11B-11D.

FIG. 12 is a partially photographic view of an exercise stations including a cable operated weight machine with a two handle exercise bar in accordance with this invention coupled to the cable of the machine. In a preferred embodiment the rack 21 is provided with two pull-down pulleys 25 for performing various pull-down weight lifting exercises. An exercise station rack 21 comprises a frame formed by base elements 26B with the lower end portions of a pair of parallel vertical frame bars 26V, with square cross sections, are secured to the base 26B with suitable securing means. The vertical frame bars 26V bars are joined in substantially parallel alignment at the top by a pair of flat horizontal header bars 26H. The flat horizontal header bars 26H are secured to the sides of the upper end portions of the vertical frame bars 26V, preferably by bolts and nuts (not shown). Pulleys 25 are rotatably supported between the horizontal header plates 26H on bearings (not shown) which are secured to the plates 26H. A third header 27H for a pair of parallel guide rods 27R, which extends horizontally, is welded to the inner surfaces of the vertical frame bars below the pulleys 25. The lower ends of the vertical frame bars 26V are secured to the frame base 26B. Each of the pair of parallel vertical guide rods 27R is affixed at the upper end portion thereof to the third header 27H. It will be noted that the base 26B extends beyond the vertical frame bars 26V to ensure stability of the rack 21 when exercises are being performed. A weight stack 30 which rides up and down on vertical guide rods 27R is coupled by main wire rope cable 24 which is coupled to wire rope cable 23 that is coupled to an adjustable angle pull bar 10 in accordance with this invention. The pulleys 25 rotatably support the cable 24 having a first end coupled through intermediate linkages including cable 23 to a pull-down bar 10 and a second end provided with a cable connector 20 for engaging the hook 28 which is connected to one or more weights 30. Thus, exercise is performed by securing weights to the cable 24 and pulling down on the bar 10, thereby lifting the weights 30.

FIG. 13 shows a wire loop connector of the kind shown in FIG. 12 for connection of the adjustable handle in accordance with this invention to an exercise cable and for interconnecting the two wire cables shown in FIG. 12.

FIG. 14 shows a spring snap hook adapted for connecting the adjustable handle of this invention to the wire loop connectors of FIG. 13.

The foregoing description discloses only exemplary embodiments of the invention. Modifications of the above disclosed apparatus and methods which fall within the scope of the invention will be readily apparent to those of ordinary skill in the art. While this invention is described in terms of the above specific exemplary embodiment(s), those skilled in the art will recognize that the invention can be practiced with modifications within the spirit and scope of the appended claims, i.e. changes can be made in form and detail, without departing from the spirit and scope of the invention. Accordingly, while the present invention is disclosed in connection with exemplary embodiments thereof, it should be understood that changes can be made to provide other embodiments which may fall within the spirit and scope of the invention and all such changes come within the purview of the present invention and the invention encompasses the subject matter defined by the following claims.

What is claimed is:

1. An exercise bar comprising:

a pair of separate handles including a left handle and a right handle having proximal ends with at least one fulcrum hole extending through the proximal end of each thereof and a lock hole therethrough spaced away from the fulcrum hole;

a center plate having a center, a to end in the center with a coupling therein, a left side, a right side, a periphery, and a pair of pivot holes extending through the center plate with one of the pivot holes on the left side and one of the pivot holes on the right side of both the coupling and the center plate;

one of a pair of pivot pins inserted through each fulcrum hole and one of the pivot holes with each of said pivot pins pivotally securing one of said left handle and said right handle to said center plate on said left and right sides thereof respectively;

openings comprising holes, detents or notches formed extending through the center plate spaced about the periphery thereof on the left and the right sides of both the coupling and the center plate; and movable locking pins for insertion through said lock holes through said left handle and through said right handle and into selected ones of the openings for retaining the left handle and the right handle at respective, separate selected angular positions on the left and right sides of both the coupling and the center plate;

whereby the angles of said left handle and said right handle with respect to said center and to each other are adjustable for different exercises with said exercise bar.

2. The exercise bar of claim 1 wherein:

the center plate openings comprise detents or notches in the periphery thereof; and each handle includes a spring biased locking pin housed therein for insertion into a selected one of the detents or notches.

3. The exercise bar of claim 1 wherein:

the center plate openings comprise detents or notches in the periphery thereof;

each handle includes a spring biased locking pin housed therein for insertion into a selected one of the detents or notches; and a coupling is connected to the center plate by a swing bearing formed therein and a shaft secured to the center plate.

4. The exercise bar of claim 1 wherein each handle has a proximal end which includes a pair of prongs and a slot therebetween for insertion onto the center plate.

5. The exercise bar of claim 1 wherein each handle has a proximal end which includes a pair of prongs and a slot therebetween for insertion onto the center plate.

6. The exercise bar of claim 3 wherein:

each handle has a proximal end which includes a pair of prongs and a slot therebetween for insertion onto the center plate; and each handle has a longitudinal slot for housing a said locking pin with shoulders extending outside the handle for manual withdrawal of the locking pin into the handle from a locking position.

7. The exercise bar of claim 1 wherein:

the center plate openings comprise lock holes extending through the center plate proximate to the periphery thereof; and each handle includes a said locking pin extending through the lock hole therethrough.

8. The exercise bar of claim 1 wherein:

the center plate openings comprise lock holes extending therethrough proximate to the periphery thereof;

each handle includes a lock pin extending through the lock hole therethrough; and a coupling formed on an upper portion of the center plate with a coupling hole therethrough.

9. The exercise bar of claim 7 wherein each handle has a proximal end which includes a pair of prongs and a slot therebetween for insertion onto the center plate.

10. The exercise bar of claim 7 wherein a coupling is connected to the center plate by a swing bearing formed therein and a swing shaft secured to a housing slot in the center plate at the top thereof by alignment slots formed in opposite ends of the swing shaft and welds of the swing shaft to the center plate.

11. An exercise bar comprising:

a center plate having a periphery and a pair of pivot holes therethrough;

a pair of handles each of which a has a proximal end including a pair of bilateral prongs separated by a transverse slot for insertion of the proximal end of the handle onto the center plate;

fulcrum holes extending through the bilateral prongs in the proximal end of each of the handles;

one of a pair of pivot pins inserted through each of the pivot holes and the fulcrum holes rotatably joining the handles to the center plate;

openings formed extending through the center plate spaced about the periphery thereof, the openings comprising detents or notches in the periphery of the center plate;

a pair of compression springs; and an associated pair of movable locking pins for each handle;

each of the pair of handles includes a coaxial bore in the proximal end thereof for housing a said locking in and a said compression spring;

a said compression spring and a said movable locking pin inserted into each of the coaxial bores;

a coupling having a means for attachment formed therein; and the coupling being connected to the center plate by a swing bearing formed therein housing a swing shaft secured to the center plate.

12. The exercise bar of claim 11 including:

a housing slot formed extending through the center plate at the top thereof with the housing slot having edges defined by the center plate;

a coupling connected to the center plate by a swing bearing and a swing shaft; and the swing shaft being secured to the edges of the housing slot in the center plate.

13. The exercise bar of claim 11 wherein:

alignment slots are formed in opposite ends of the swing shaft which overlap the edges of the housing slot; and welds are formed between the ends of the swing shaft and the center plate along the edges of the housing slot thereby securing the swing shaft to the center plate.

14. The exercise bar of claim 11 wherein the pivot pin comprises a hollow spring pin.

15. The exercise bar of claim 11 wherein each said locking pin is inserted into a selected one of the openings which retains the handle associated therewith at selected angular position relative to the center plate under mechanical bias exerted by the compression spring associated therewith.

16. The exercise bar of claim 15 wherein each said compression spring biased locking pin retains the handle associated therewith in a locked position relative to the periphery of the center plate by insertion thereof in a selected one of the openings comprising a said detent or a said notch.

17. The exercise bar of claim 11 wherein:

the pivot pin comprises a hollow spring pin; and each of the locking pins is inserted into a selected one of the openings for retaining the handle associated therewith at selected angular position relative to the center under mechanical bias exerted by the compression spring associated therewith.

18. The exercise bar of claim 14 wherein each of the locking pins is inserted into a selected one of the openings for retaining the handle associated therewith at a selected angular position relative to the center plate under mechanical bias exerted by the compression spring associated therewith.

19. The exercise bar of claim 15 wherein each of the locking pins is inserted into a selected one of the openings for retaining the handle associated therewith at selected angular position relative to the center plate under mechanical bias exerted by the compression spring associated therewith.

20. A method of operating of an exercise bar comprising:

a pair of separate handles including a left handle and a right handle having proximal ends with at least one fulcrum hole extending through the proximal end of each thereof and a lock hole therethrough spaced away from the fulcrum hole, a center plate having a to end and a periphery, a coupling centered in the top end, and a pair of pivot holes extending through the center plate on opposite sides of both the coupling and the center plate with a pair of pivot pins inserted through each of the fulcrum hole and a pivot hole;

openings comprising holes, detents or notches formed extending through the center plate spaced about the periphery of the center plate; and movable locking elements comprising spring biased locking pins or removable locking pins;

the method including the adjusting angles of the handles by the steps as follows:

releasing at least one of the locking elements for at least one of the handles which is in a first position;

adjusting angular position of the handle from the first position to a second position;

altering positions of the movable locking elements into selected ones of the openings for retaining the handles at separate, selected angular positions relative to the center plate.

* * * * *